US009771174B2

(12) United States Patent
Murray

(10) Patent No.: US 9,771,174 B2
(45) Date of Patent: Sep. 26, 2017

(54) FLEXIBLE FUNNEL FOR FILLING A POUCH WITH A PRODUCT

(71) Applicant: R. Charles Murray, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 204 days.

(21) Appl. No.: 14/032,230

(22) Filed: Sep. 20, 2013

(65) Prior Publication Data

US 2014/0020339 A1 Jan. 23, 2014

Related U.S. Application Data

(63) Continuation of application No. 12/840,617, filed on Jul. 21, 2010, now Pat. No. 8,562,274, which is a (Continued)

(51) Int. Cl.
*B65B 39/02* (2006.01)
*B65B 39/00* (2006.01)
(Continued)

(52) U.S. Cl.
CPC ..... *B65B 39/02* (2013.01); *B65B 39/007* (2013.01); *B65B 1/04* (2013.01); *B65B 43/16* (2013.01);
(Continued)

(58) Field of Classification Search
CPC ..... B65B 54/345; B65B 54/50; B65B 37/02; B65B 2210/08; B65B 39/007; B65B 39/02; B65B 1/06; B65B 43/345; B65B 43/50; B65B 43/18; B65B 1/16; B65B 1/18; B65B 1/28; B65B 1/04; B65B 3/04; B65B 3/045; B65B 3/06; B65B 39/06; B65B 39/00; B65B 67/1205; B65B 67/04; B67C 11/02; B67C 11/00; B67C 2011/027; B67C 11/04; B65D 2231/007; B65D 88/26; B65D 2517/0049; B65G 47/19; B65G 11/103;
(Continued)

(56) References Cited

U.S. PATENT DOCUMENTS 733,449 A 7/1903 Willsie
1,408,865 A * 3/1922 Cowell ..... 141/338
(Continued)

FOREIGN PATENT DOCUMENTS

EP 1254837 A1 * 11/2002
EP 1577223 9/2005
(Continued)

*Primary Examiner* — Glenn Myers
(74) *Attorney, Agent, or Firm* — Dinsmore & Shohl LLP

(57) ABSTRACT

A flexible funnel positioned at a filling station of a fill machine. The flexible funnel directs a product dispensed at the filling station of the filling machine into a pouch. The flexible funnel having a rigid upper portion and a plurality of fingers. The rigid upper portion includes an open top end and an open bottom end. Each of the plurality of elongated fingers hingedly connected to the upper portion. The rigid upper portion has a regular polygon shape having a plurality of sides, and each of the plurality of fingers is individually articulatable with respect to one of the plurality of sides of the upper rigid portion.

14 Claims, 13 Drawing Sheets

Related U.S. Application Data continuation-in-part of application No. 11/947,173, filed on Nov. 29, 2007, now abandoned.

(60) Provisional application No. 60/867,657, filed on Nov. 29, 2006.

(51) Int. Cl.

| | |
|---|---|
| *B65B 1/04* | (2006.01) |
| *B65B 43/16* | (2006.01) |
| *B65B 43/18* | (2006.01) |
| *B65B 43/30* | (2006.01) |
| *B65B 43/46* | (2006.01) |
| *B65B 43/50* | (2006.01) |
| *B65B 51/14* | (2006.01) |
| *B65B 61/28* | (2006.01) |

(52) U.S. Cl.
CPC ..... *B65B 43/18* (2013.01); *B65B 43/30* (2013.01); *B65B 43/465* (2013.01); *B65B 43/50* (2013.01); *B65B 51/146* (2013.01); *B65B 61/28* (2013.01)

(58) Field of Classification Search
CPC ..... B65G 11/106; B65G 11/10; A47J 42/50; C10B 31/02; C10B 31/04
See application file for complete search history.

(56) References Cited

U.S. PATENT DOCUMENTS 1,538,171 A * 5/1925 Dailey ..... 141/338
1,563,005 A 11/1925 Allee
1,983,547 A 12/1934 Knowlton
2,008,216 A 7/1935 Lombi
2,031,005 A * 2/1936 Renfroe ..... B65B 67/04 53/248
2,106,028 A 1/1938 Heimsch et al.
2,189,174 A 2/1940 Hohl
2,348,144 A * 5/1944 Opie ..... A47J 27/20 53/261
2,664,238 A * 12/1953 Vogt ..... B65B 43/123 141/166
2,703,671 A 3/1955 Kindseth
2,722,358 A 11/1955 Wilson
2,759,643 A 8/1956 Dahlin
2,865,157 A * 12/1958 Talsma ..... B65B 39/02 53/261
2,904,945 A * 9/1959 Kerr ..... B65B 39/02 53/284.5
3,010,619 A 11/1961 Gronemeyer et al.
3,286,005 A 11/1966 Cook
3,304,977 A 2/1967 Hammons
3,498,344 A * 3/1970 Bruder ..... B65B 39/08 141/317
3,589,458 A * 6/1971 Schwake ..... B65B 37/18 177/122
3,618,684 A * 11/1971 Burke ..... G01G 13/24 141/67
3,855,907 A 12/1974 Johnson et al.
3,924,008 A 12/1975 Ford et al.
3,938,658 A 2/1976 Rohde
4,078,717 A 3/1978 Stearley
4,247,021 A * 1/1981 Renier ..... B65D 90/205 222/143
4,326,568 A 4/1982 Burton et al.
4,361,235 A 11/1982 Gautier
4,498,591 A 2/1985 Smith, II
4,519,499 A 5/1985 Stone et al.
4,690,304 A 9/1987 Morel
4,703,782 A * 11/1987 Henkel, Sr. ..... B65B 1/26 141/114
4,717,046 A 1/1988 Brogli
4,774,797 A 10/1988 Colamussi et al.
4,808,010 A 2/1989 Vogan
4,848,421 A 7/1989 Froese et al.
4,861,414 A 8/1989 Vogan
4,867,131 A 9/1989 van der Merwe et al.
4,892,512 A 1/1990 Branson
4,905,452 A 3/1990 Vogan
4,998,671 A 3/1991 Leifheit
4,999,978 A 3/1991 Kohlbach et al.
5,104,008 A 4/1992 Crisci
5,111,126 A 5/1992 Powell et al.
5,222,535 A 6/1993 Roders
5,267,591 A 12/1993 Wakabayashi et al.
5,271,589 A * 12/1993 Belous ..... 248/97
5,377,873 A 1/1995 Minnette
5,403,056 A 4/1995 Wallace
5,433,526 A 7/1995 Wild
5,465,707 A 11/1995 Fulcher et al.
5,485,714 A 1/1996 Montalvo
5,492,219 A 2/1996 Stupar
5,707,677 A 1/1998 Gonsalves et al.
5,836,445 A 11/1998 Provonchee
5,845,466 A 12/1998 Laudenberg
5,855,544 A 1/1999 Buchanan
5,906,438 A 5/1999 Laudenberg
5,911,340 A 6/1999 Uematsu
5,954,432 A 9/1999 Laudenberg
5,979,512 A * 11/1999 McGregor ..... B65B 1/32 141/10
5,992,689 A * 11/1999 Johanson ..... B65G 47/5195 222/503
6,039,218 A 3/2000 Beck
6,050,059 A 4/2000 Rea
6,065,651 A 5/2000 Tedeschi, Jr. et al.
6,116,231 A 9/2000 Sabin et al.
6,141,122 A 10/2000 Ishimaru
6,163,145 A 12/2000 Yamada et al.
6,199,351 B1 * 3/2001 Mount ..... 53/563
6,199,601 B1 3/2001 Laudenberg
6,217,497 B1 4/2001 Laudenberg
6,241,122 B1 6/2001 Araki et al.
6,276,788 B1 8/2001 Hilton
6,422,753 B1 7/2002 Thomas
6,439,429 B1 8/2002 Gross
6,513,516 B2 2/2003 Sabin et al.
D474,682 S 5/2003 Berman
6,571,994 B1 6/2003 Adams et al.
6,598,374 B1 * 7/2003 Ensor ..... B65B 37/20 141/114
6,640,801 B2 11/2003 Sabin et al.
6,651,848 B1 11/2003 Redmond
6,662,532 B1 * 12/2003 Droog ..... B65B 43/36 53/373.6
6,695,571 B1 2/2004 Canella
6,719,015 B2 4/2004 Murray
6,752,585 B2 6/2004 Reimer et al.
6,836,445 B2 12/2004 Lee
6,931,824 B2 8/2005 Rogers
6,935,492 B1 8/2005 Loeb
6,981,614 B2 1/2006 Niggemyer
7,334,449 B2 2/2008 Neubauer
2002/0074247 A1 * 6/2002 Tremblay ..... 206/223
2002/0144880 A1 10/2002 Ikemoto et al.
2004/0013774 A1 1/2004 Dibbs
2004/0099333 A1 5/2004 Tsai et al.
2004/0206777 A1 10/2004 Mertens
2004/0261370 A1 12/2004 Rea et al.
2005/0040181 A1 2/2005 Kurosawa et al.
2005/0044700 A1 3/2005 Ghuman et al.
2005/0196211 A1 9/2005 Miki
2006/0062497 A1 3/2006 Murray
2006/0182607 A1 8/2006 Clark et al.

(56) References Cited

U.S. PATENT DOCUMENTS

| | | | |
|---|---|---|---|
| 2006/0196784 | A1 | 9/2006 | Murray |
| 2007/0144113 | A1 | 6/2007 | Murray |

FOREIGN PATENT DOCUMENTS

| | | | |
|---|---|---|---|
| JP | 10175649 | A | 6/1998 |
| JP | 11049186 | A | 2/1999 |
| JP | 11091807 | A | 4/1999 |
| JP | 2000281089 | A | 10/2000 |
| JP | 2000335594 | A | 12/2000 |
| JP | 2001048200 | A | 2/2001 |
| JP | 2001122206 | A | 5/2001 |
| WO | 2004054888 | | 7/2004 |

* cited by examiner

FLEXIBLE FUNNEL FOR FILLING A POUCH WITH A PRODUCT

CROSS-REFERENCE TO RELATED APPLICATIONS

This application is a continuation of U.S. patent application Ser. No. 12/840,617, filed Jul. 21, 2010, which is a continuation-in-part of U.S. patent application Ser. No. 11/947,173 filed Nov. 29, 2007, now abandoned, which claims priority of U.S. Provisional Patent Application Ser. No. 60/867,657 filed Nov. 29, 2006, both of which are incorporated herein by reference.

FIELD OF THE INVENTION

The present invention relates generally to a system for precisely transferring a pouch from a pouch delivery device into a fill-seal machine and, more particularly, to a system having a robotic transfer device capable of determining the pouch dimensions and precisely load the pouch into grippers a predetermined height from the upper edge of the pouch.

BACKGROUND OF THE INVENTION

Automated manufacturing processes incorporating a high speed fill-seal machine typically involves transferring a container into the machine. The container may be a disposable portable container for storing a product such as a preformed flexible pouch or tray. The preformed pouch is loaded into the fill-seal machine to complete the steps of filling and sealing the pouch prior to its exit from the high speed machine where it is typically packaged in bulk for transit.

As the preformed pouches include numerous different shapes and sizes, a pouch must be positioned in a specific manner so that the pouches are correctly loaded into the fill-seal machine. Specifically, it is of vital importance that the pouch is positioned within the grippers of the fill-seal machine at a specific height. The positioning of the pouch is of importance as the distance between the upper edge of the pouch and the grippers affects the width of the seal and the types of seals capable of being performed on the pouch. If the pouch is positioned within the grippers with too much distance between the upper edge and the grippers, the width of the seal may be excessive and/or leave a portion of the pouch adjacent the upper edge unsealed which later has to be trimmed prior to packaging. In contrast, if the distance between the upper edge of the pouch and the grippers is too small, the width of the seal may be ineffective for properly sealing the pouch.

In order to keep pace with the high speed machine, a robotic transfer device is used to load the preformed pouches into the fill-seal machine. However, these robotic transfer devices must be precisely taught the pouch specifications including pouch size and the preferred distance between the upper edge of the pouch and the gripper member. The robotic transfer device teaching is time consuming as the high speed fill-seal machine must be shut down, resulting in a loss of productivity. A human operator must then enter the specifications of the pouch into the robotic transfer device prior to the high speed fill-seal machine being restarted.

In addition, the high speed fill-seal machine often includes adjustable grippers capable of adjusting the width between each gripper arm and thereby providing a versatile machine capable of filling and sealing a variety of differently sized pouches. Typically, the previously known gripper adjustment required the fill-seal machine to be shut down and the width of the grippers to be manually adjusted prior to the restarting of the fill-seal machine. As such, the additional downtime results in a loss of productivity and increases in labor costs.

Once properly positioned within the grippers, the pouch is moved through the various stations of the fill-seal machine. In order for the pouch to be filled, the pouch must first be opened and kept opened during the filling process. Previously known, openers included grippers which translated inwards forcing the side edges of the pouch together and/or suction cups which attached to the front and back of the pouch and translated outward to open the pouch. However, these previously known types of openers often do not fully open the pouch which prevents a diving funnel from entering the pouch. Further, previously known diving funnels include a rigid design which often damages the contents as they are loaded into the pouch. The rigid design of the diving funnels also resulted in jams as contents blocked the exit of the funnel.

Thus, there exists a need for a smart system for continuously and precisely positioning the preformed pouches within the grippers of the fill-seal machine, automatically adjusting the gripper width, and opener which allows a diving funnel to properly fill the pouches in the fill-seal machine.

SUMMARY OF THE INVENTION

The present invention provides an improved system, method, and machine for continuous loading of a pouch into a high speed fill-seal machine which overcomes the above-mentioned disadvantages of the previously known transfer and teaching techniques.

In brief, a load smart system for continuously loading preformed pouches into a fill-seal machine is provided. A plurality of pouches are disposed within a pouch delivery device, each of the pouches having an upper edge and an orientation indicia. The fill-seal machine includes a rotating turret having a plurality of radially extending gripper pairs. The rotating turret rotates the plurality of gripper pairs between a loading station, an opening station, a filling station, a sealing station, and an unloading station. A robotic transfer device is positioned between the pouch delivery device and the loading station of the fill-seal machine. The robotic transfer device includes a gripper member and an optical sensor. During operation, the optical sensor scans the indicia to determine the pouch characteristics and the gripper member aligns the pouch in a predetermined orientation and deposits the pouch within the gripper pairs at the loading station a predetermined distance from the upper edge of the pouch.

The system includes a control station having a computer processing unit in communication with a database having a plurality of preloaded pouch characteristics correlating to the pouch indicia. Upon scanning of the indicia by the optical sensor, the computer processing unit accesses the database to determine the size, orientation, and predetermined distance between the upper edge of the pouch and the gripper members so as to control the robotic transfer device to correctly pick up the pouch, orient the pouch, and precisely deposit the pouch within the gripper pairs of the loading station at a predetermined distance from the upper edge of the pouch.

The system further includes an automated gripper with adjustment mechanism in communication with the control station to automatically adjust the width of the grippers. An advantage of the automated gripper adjustment mechanism is that an operator can enter a pouch width into an input/output display device attached to the control station and the mechanism will precisely adjust the gripper width.

BRIEF DESCRIPTION OF THE DRAWINGS

A better understanding of the present invention will be had upon reference to the following detailed description when read in conjunction with the accompanying drawings, wherein like reference characters refer to like parts throughout the several views, and in which.

DETAILED DESCRIPTION OF A PREFERRED EMBODIMENT OF THE PRESENT INVENTION

The present invention has utility as a load smart system for precisely loading preformed pouches into a fill-seal machine. By providing an indicia on the pouch which is scanned by the optical sensor on the gripper member of the robotic transfer device to provide the robotic transfer device with pouch characteristics, eliminates the need for an operator to manually enter the pouch into the grippers of the fill-seal machine. Further, the system is advantageous in that the width of the grippers on the fill-seal machine can be automatically adjusted through the control station rather than manually manipulated. In addition, a reciprocating opening device enters the pouch at the opening station and travels with the pouch from the opening station to the loading station where a flexible diving funnel enters the pouch between the opening fingers of the reciprocating opening device. After filling, the reciprocating opening device returns to the opening station.

Figure 1:
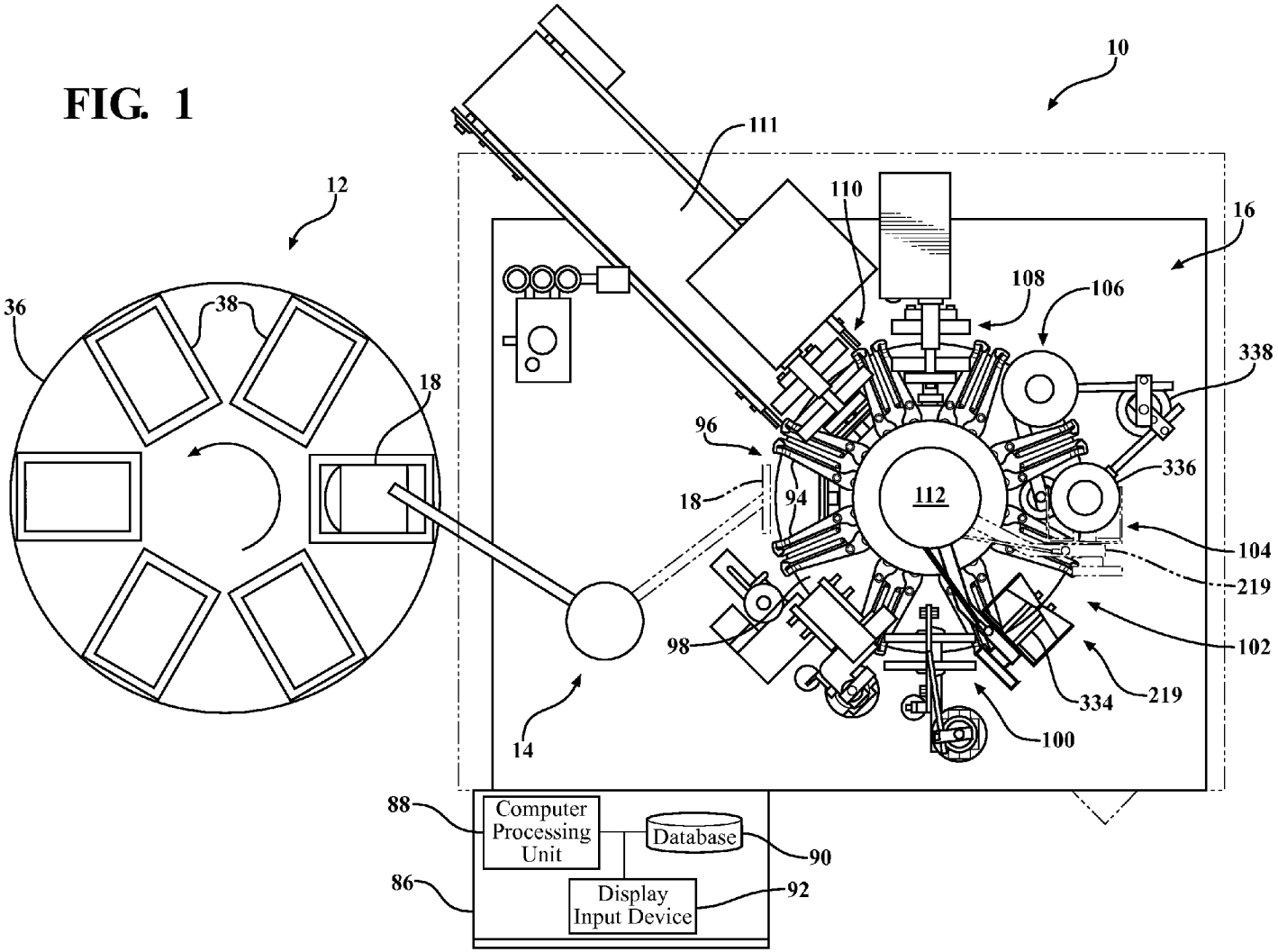
FIG. 1 is a plane view of a system for continuously loading preformed pouches into a fill-seal machine.

With reference to FIG. 1, a load smart system is generally indicated at 10. The load smart system 10 includes a pouch delivery device 12, a robotic transfer device 14, and a high speed fill machine or a fill-seal machine 16. It is appreciated that although the system 10 is depicted as having a fill-seal machine 16, the system optionally includes a fill machine operating in substantially the same manner as the fill-seal machine without the sealing station. A plurality of preformed flexible pouches 18 are disposed within the pouch delivery device 12 awaiting transfer to the fill-seal machine 16 by the robotic transfer device 14.

Figure 3A:
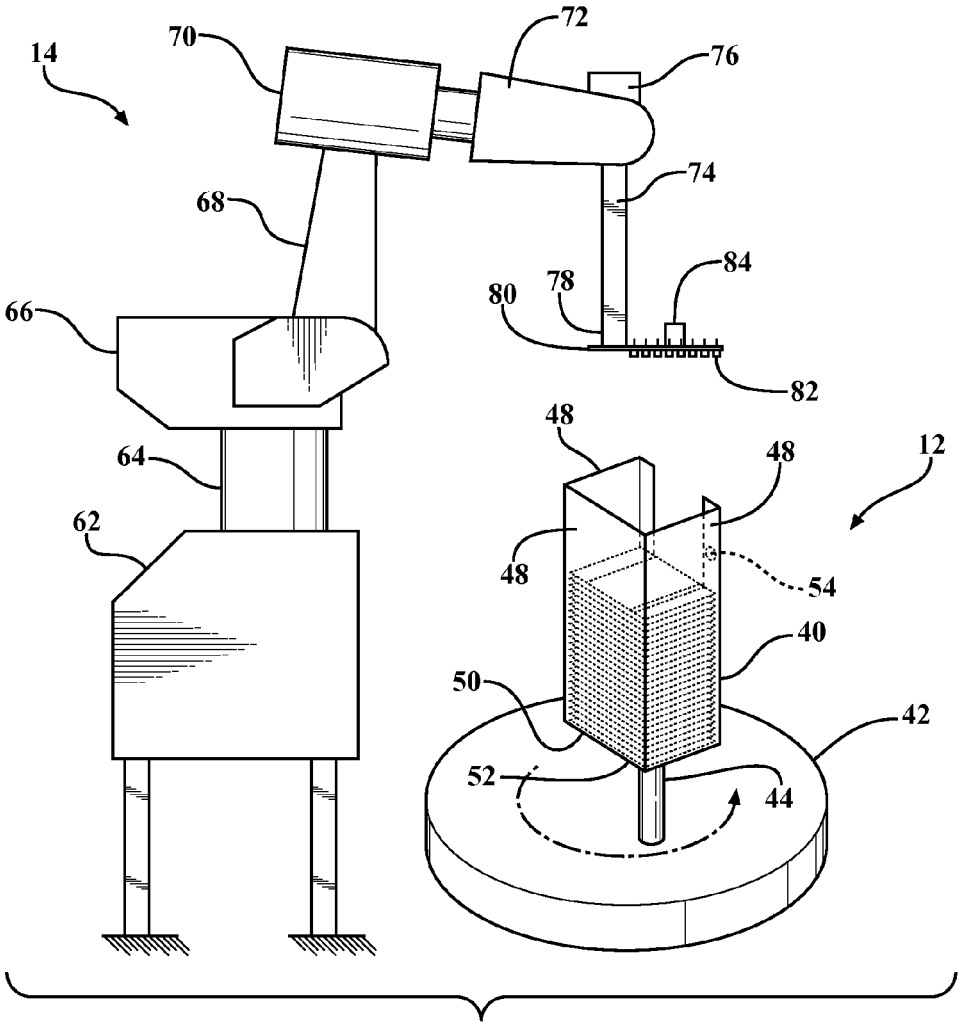
FIG. 3A is a schematic view of the robotic transfer device and the pouch delivery device.
Figure 3B:
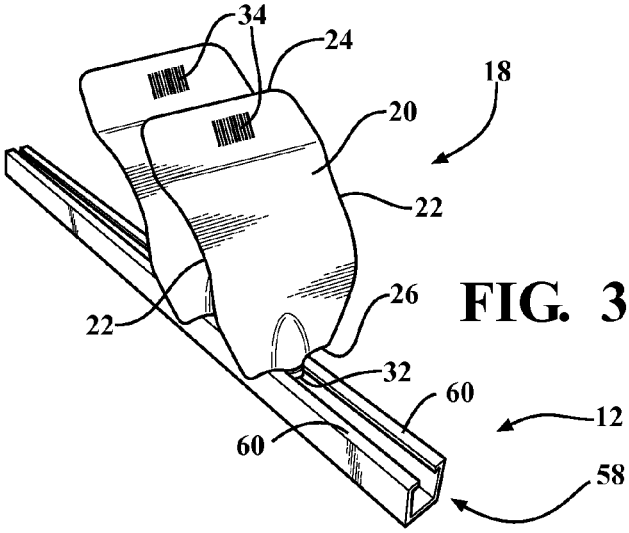
FIG. 3B is an alternative pouch delivery device.
Figure 3C:
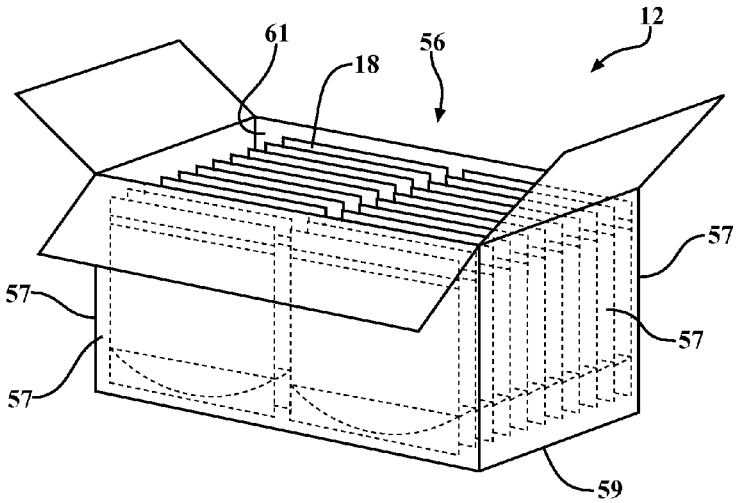
FIG. 3C is an additional alternative of a pouch delivery device.
Figure 3D:
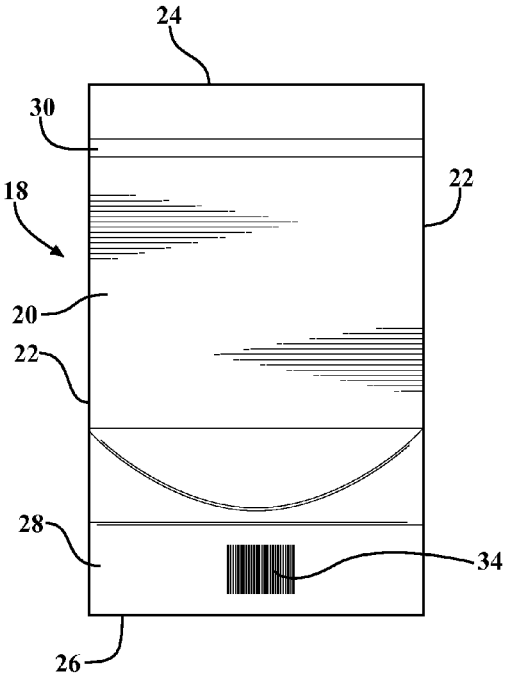
FIG. 3D is an elevational view of a preformed flexible pouch having the orientation indicia.
Figure 3E:
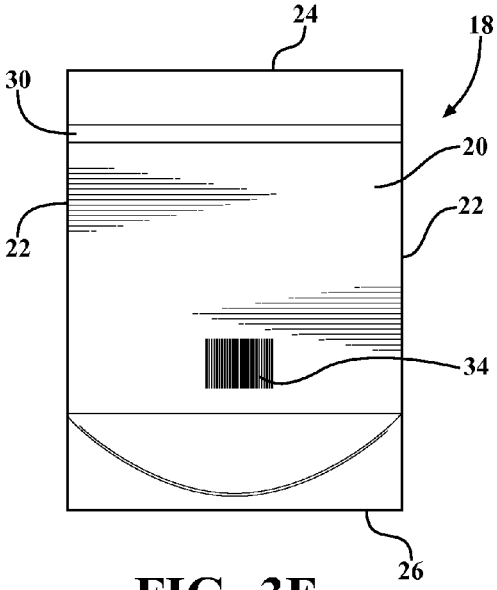
FIG. 3E is a top elevational view of a flexible preformed pouch having the orientation indicia in an alternative position.

Referring to FIGS. 3D and 3E, the flexible pouch 18 is preferably formed from a roll of flexible, preprinted laminate material. The choice of laminate material is nonlimiting and is influenced by factors such as the product to be contained, the shape, or the anticipated use of the pouch 18. The pouches 18 includes a front wall 20, a back wall (not shown), an upper edge 24, an opposed lower edge 26 and side edges 22 extending between the upper edge 24 and lower edge 26. During the formation of the pouches 18, the sides edges 22 and the lower edge 26 are sealed using heat or ultrasonics or by a combination of heat and ultrasonics. The upper edge 24 is left unsealed to facilitate filing of the pouches 18 in the fill-seal machine 16. After filling, the upper edge 24 is then sealed by the fill-seal machine 16 using heat or ultrasonics or by a combination of heat and ultrasonics. The upper edge 24 optionally includes an elongated spout or neck. It is appreciated, of course, that the designation of upper edge 24 and the lower edge 26 are merely for reference purposes only with the upper edge 24 being the portion of the pouch 18 through which product enters in the fill-seal machine 16.

The pouch 18 is optionally formed from a single sheet of material which is manipulated so that the side edges 22 are joined together to form a seam between the front wall 20 and the back wall. In the alternative the pouch 18 is formed from two sheets of material defining the front wall 20 and the back wall which are joined by sealing the side edges 22 of the two facing sheets of material. The shape of the pouch 18 is defined by its intended use, intended contents, or to define an aesthetically pleasing appearance such as a shaped pouch having linear or curvilinear edges. It is appreciated, of course, that these examples are merely illustrative of pouch shapes and other pouches may be utilized.

As seen in FIG. 3B, the pouch 18 optionally includes a feature such as a gusset 28 which is integrally formed with the pouch 18 or as a separate piece of material as an insert. The gusset 28 is optionally located between any of the edges of the pouch 18 such as the side edges 22 or the lower edge 26.

The pouch 18 includes an opener 30 for easily accessing the contents or dispensing the contents from the pouch 18. Various types of openers 30 are optionally incorporated into the pouch 18 prior to the filling of the pouch 18, or in the alternative the opener 30 is added to the pouch 18 by the fill-seal machine 16. The various types of openers 30 illustratively include an integrally formed tear notch having a tear line which defines a tear-off portion, a resealable zipper which provides a hermetic seal through the use of interlocking teeth such as a press-to-close or a slide zipper, a weakened straw-pierceable portion in the pouch for receiving a straw, and a pull tab covering an opening in the pouch.

In addition, the pouch 18 optionally includes a fitment 32 such as a removable and replaceable cap secured to a spout mounted between the front wall 20 and the back wall of the pouch 18, as seen in FIG. 3B. The fitment 32 is optionally secured to the lower edge 26 of the pouch 18 during the formation process leaving the upper edge 24 unsealed to facilitate filling in the fill-seal machine 16.

An indicia 34, in the form of a readable barcode, universal product code (UPC), two-dimensional data matrix, or a radio frequency identification (RFID) tag is visibly positioned on the pouch 18. The indicia 34 is disposed 34 on the exterior of the pouch 18, such as the front wall 20, the back wall, or the gusset 28. The indicia 34 is specific to each pouch 18 having a different shape, size, and/or product to be contained.

The above-described features are merely illustrative and the preformed flexible pouch 18 may incorporate any of the above-described features or any other feature in any combination. In addition, the finished pouch 18 may assume various shapes such as cylindrical, cubical, spherical, conical, an hourglass, or the like as defined by the intended contents and usage of the pouch 18.

The preformed flexible pouches 18 are stored in pouch delivery device 12 prior to loading into the fill-seal machine 16. As seen in FIG. 1, the pouch delivery device 12 includes a rotating turntable 36 having a plurality of pouch holders 38 in which the pouches 18 are stored. The turntable 36 rotates in a predetermined direction allowing for the placement of the pouch holders 38 in an appropriate location with respect to the robotic transfer device 14 in order to provide a continuous supply of pouches 18 to the fill-seal machine 16. After the robotic transfer device 14 has removed all of the pouches 18 from one of the pouch holders 38, the turntable 36 rotates to position another pouch holder 38 in the appropriate location with respect to the robotic transfer device 14. The empty pouch holders 38 can be refilled with pouches 18 by an operator without interrupting operation of the fill-seal machine 16. In the alternative, the operator periodically unloads the empty pouch holders 38 and replaces them with full pouch holders 38 filled with pouches 18.

Another example of a pouch delivery device 12 is shown at FIG. 3A is a magazine 40 connected to a rotatable base 42 by a pusher member 44 extending perpendicular to the rotatable base 42. The pusher member 44 is of a cylindrical shape and includes a free end having a plate 46 which supports the pouches 18 contained within the magazine 40. The magazine 40 includes a plurality of side walls 48 and a base wall 50 having an aperture 52 for receiving the pusher member 44. The side walls 48 and the base wall 50 form a receptacle for storing the pouches 18 on the plate 46.

The pusher member 44 is longitudinally movable through the magazine 40 upon rotation of the rotatable base 42 thereby providing the topmost pouch 18 in the magazine 40 at a consistent height for the robotic transfer device 14. The magazine 40 optionally includes a level sensor 54, such as a proximity sensor, capable of detecting the level of the pouches 18 within the magazine 40. The magazine 40 includes a controller (not shown) operatively in communication with an actuator and the level sensor 54 that uses the information from the level sensor 54 to cause the rotatable base 42 to rotate thereby extending the pusher member 44 through the aperture 52 of the base wall 50 of the magazine 40 raising the plate 46 to maintain a consistent level of pouches 18 within the magazine 40.

Another example of a pouch delivery device is disclosed in FIG. 3C. The pouch delivery device 12 is in the form of a container 56 having two pairs of opposing side walls 57 and a bottom wall 59 defining a storage space 61 for storing a plurality of pouches 18. The pouches 18 are disposed within the container 56 in a variety of different manners including stacked on the upper edge 24 or the bottom edge 26, stacked with either the front wall 20 or the back wall facing the bottom wall 59.

In instances where the pouch 18 includes a fitment 32 or other feature attached to either the front wall 20 or the back wall and extends beyond the exterior of the pouch 18, the pouches 18 are optionally stacked in an alternating manner such that the first pouch is stacked with the back wall facing the pouch delivery device 12. The second pouch 18 is stacked with the front wall 20 facing the front wall 20 of the first pouch such that the fitments 32 share the space between the front wall 20 of the second pouch and the front wall 20 of the first pouch. The alternating stacking of the pouches 18 allows a plurality of pouches 18 to be stacked in a more compact manner.

It is appreciated, of course, that that a plurality of magazines 40 with or without rotating bases 42 or a plurality of containers 56 are placed on the turntable 36 in placement of the pouch holders 38. It is also appreciated that the pouch holders 38, the magazine 40, and the container 56 have a shape which is selected to correspond to the shape of the pouches 18 contained therein. The pouch delivery device 12 optionally includes an intermediate wall which divides the pouch holders 38, magazines 40, and containers 56 into sections allowing a plurality of stacks of pouches 18 to be stored therein. The pouch delivery device is optionally in the form of a conveyor belt having an unloading end adjacent the robotic transfer device.

In the alternative, a generally U-shaped chute 58 is used as a pouch delivery device 12 for pouches 18 having fitments 32 on the lower edge 26, as seen in FIG. 3B. The fitments 32 are disposed within the U-shaped chute 58 which includes flanges 60 extending inwardly to restrain the fitments 32 within the chute 58. In this manner, the pouches 18 are provided to the robotic transfer device 14 as they slide within the chute 58 through the use of gravity, blown air, vacuum, or a conveyor type system having fingers which push each pouch 18 through the chute 58.

Figure 4:
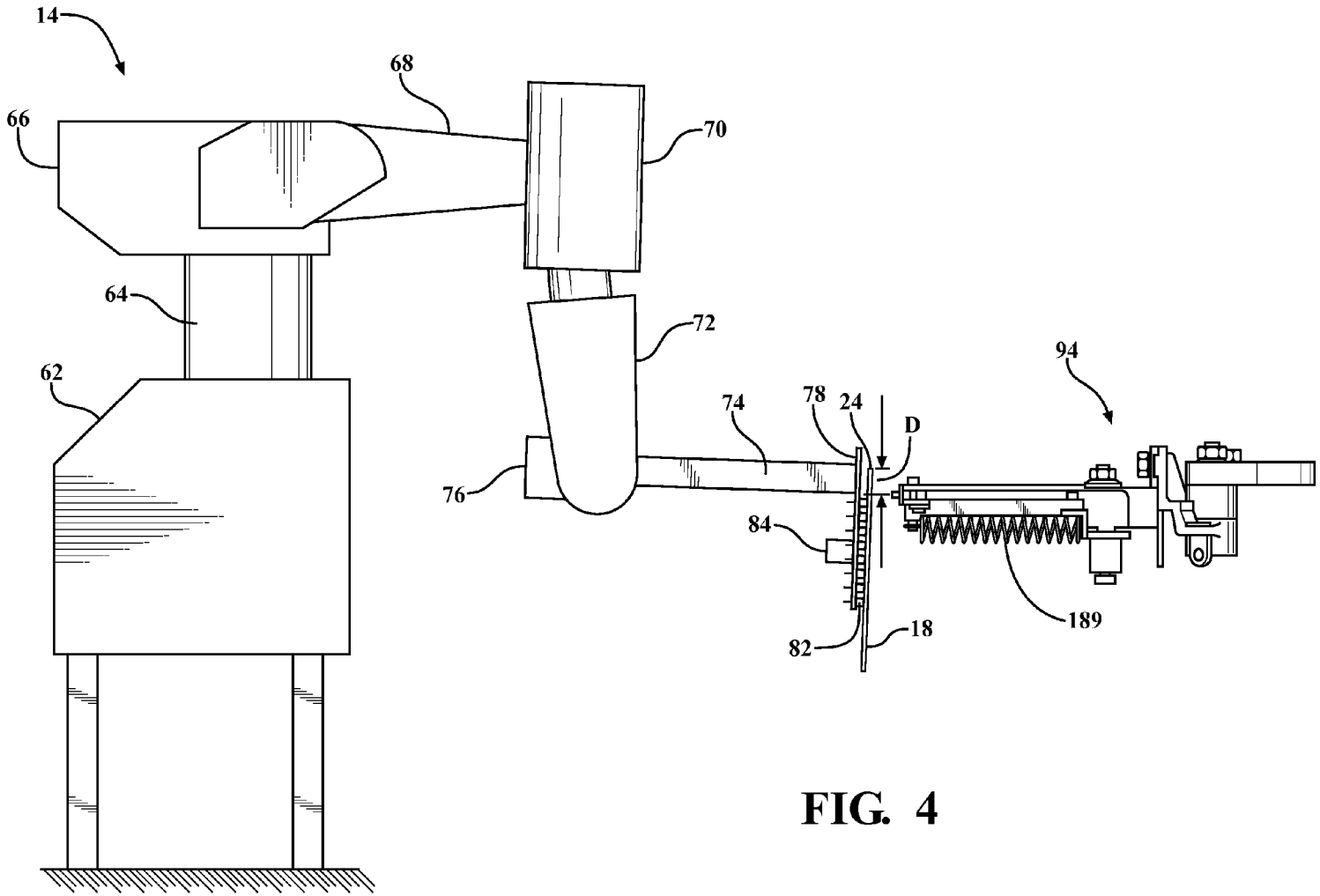
FIG. 4 is a side elevational view of the robotic transfer device depositing the preformed pouch into the gripper of the fill-seal machine.

Referring to FIGS. 3A and 4, a robotic transfer device 14 is provided. The robotic transfer device 14 incorporates a base portion 62 disposed between the pouch delivery device 12 and the fill-seal machine 16 as seen in FIG. 1. A trunk portion 64 is operatively rotatably attached to the base portion 62 at one end and includes a second base portion 66 attached to an opposite end of the trunk portion 64. The trunk portion 64 allows the second base 66 portion to rotate relative to the base portion 62.

A first arm 68 is attached to the second base portion 66 at a proximate end and is connected to a joint 70 at a distal end. The first arm 68 is movable relative to the second base portion 66 and the joint 70 is rotatable about the first arm 68. A second arm 72 is rotatably attached to the joint 70. A boom 74 having a first end 76 and an opposite second end 78 is attached to the second arm 72. The boom 74 is formed of an elongated cylindrical rod movable in the longitudinal direction relative to the second arm 72 in order to vary the distance between the second end 78 and the second arm 72.

A swivel plate 80 is rotatably attached to the second end 78 of the boom 74. A gripper member 82 is attached to the swivel plate 80 for picking up the pouches 18 from the pouch delivery device 12. An optical sensor 84 is positioned on the swivel plate 80 in order to sense the indicia 34 positioned on the pouch 18. The optical sensor 84 includes a bar code reader for reading the indicia 34 in the form of a bar code or two dimensional data matrix, an image capture device, or a radio frequency identification code reader to receive information from the indicia 34 in the form of a RFID tag.

Various types of gripper members 82 are available and depend upon the type of pouch 18 to be picked up. The gripper members 82 illustratively include but are not limited to vacuum assisted suction cups, a mechanical gripper, an adhesive, or any combination thereof.

The configuration of the robotic transfer device 14 allows its articulation through various three-dimensional movements in order to properly pick up the pouch 18 from the pouch delivery device 12 at a pickup position and deposit the pouch 18 into a loading station, described in greater detail below, of the fill-seal machine 16 at a load position. In the alternative, the robotic transfer device 14 is in the form of a pick and place mechanism which picks up the pouches 18 from a pouch delivery device 12 in the form of a conveyor belt and places the pouches 18 within the grippers 94.

The movement of the robotic transfer device 14 is performed by any articulation means known in the art illustratively including hydraulics, electronically controlled servos, or any combination thereof, operated under control of a control station 86 in communication with the robotic transfer device 14. The control station includes a controller 88 in the form of a computer processing unit, a database 90, and a display/input device 92. The robotic transfer device 14 via computer control by the control station 86 operates under the sequential movements based on the XYZ coordinates stored in the database 90 to position the gripper member 82 at the pickup position in order to pick up a pouch 18 from the pouch delivery device 12 and articulate the robotic transfer device 14 through the sequential movements to deposit the pouch 18 in the loading station of the fill-seal machine 16 at a loading position.

As seen in FIG. 4, the robotic transfer device 14 is positioned in the loading position depositing the pouch 18 into grippers 94 positioned at the loading station of the fill-seal machine 16. As the fill-seal machine 16, the robotic transfer device 14, and the pouch delivery device 12 are each operable to accommodate various sizes and types of pouches 18, the database 90 includes a plurality of preloaded pouch characteristics correlating to the particular indicia 34 on the pouches. The pouch characteristics include the dimensions of the pouch 18, the orientation of the pouch 18 within the pouch delivery device 12, the predetermined distance between the upper edge 24 of the pouch 18 and the grippers 94, the width of the pouch 18, the manner in which the pouch 18 is stacked within the pouch delivery device 12, a reference image of the pouch 18, and the sequential movements based on the XYZ coordinates to position the gripper member 82 of the robotic transfer device 14 in the pick up position to pick up the pouch 18 from the pouch delivery device 12 and transfer the pouch 18 to the loading position in order to properly deposit the pouch 18 into the grippers 94 with a predetermined distance D between the upper edge 24 and the grippers 94.

In order to determine the proper sequential movement for articulating the robotic transfer device 14 from the pickup position to the load position, the optical sensor 84 scans the indicia 34 on the pouch 18 and transmits the information to the control station 86. The controller 88 accesses the database 90 to correlate the scanned information with one of the preloaded pouch characteristics to determine the proper sequential movements. As the load smart system 10 is operable to process a variety of different pouch types and sizes, the pouch characteristics stored on the database 90 include various pouch information such as the proper sequential movements based on the XYZ coordinates to articulate the robotic transfer device 14 from the pickup position to the load position, particularly the proper distance between the upper edge 24 of the pouch 18 and the grippers 94 as pouches 18 of different sizes require a difference distance D as seen in FIG. 4. Pouches 18 of the same size undergoing different sealing processes also require a different distance D between the upper edge 24 of the pouch 18 and the grippers 94. The preloaded pouch characteristics stored on the database 90 further include the orientation of each of pouches 18 stored in the pouch delivery device 12 as different pouches 18 have the open end for facilitating filling in the fill-seal machine 16 stored in the pouch delivery device in different manners. In addition, the preloaded pouch characteristics also include the precise manner in which the pouches 18 are stacked within the pouch delivery device 12 as pouches 18 including features such as fitments 32 are often stacked in an alternating manner. Therefore, a plurality of sequential movements may be included in the pouch characteristics of a single pouch 18 based off the indicia 34.

In operation, the robotic transfer device 14 will position the gripper member 82 in a pre-pickup position in order for the optical sensor 84 to scan the indicia 34 on the pouch 18 disposed within the pouch delivery device 12. In the pre-pickup position, the swivel plate 80 is positioned such that the optical sensor 84 is in a position above the pouch delivery device 12 (either the pouch holders 38, magazines 40, or containers 56) to allow the optical sensor 84 to read the indicia 34 on the pouch 18. The read indicia 34 is then transmitted to the control station 86 wherein the controller 88 accesses the database 90 in order to determine the corresponding preloaded pouch characteristics including the sequential movements of the robotic transfer device 14 including the predetermined distance D between the upper edge 24 of the pouch 18 and the grippers 94. As stated above, in some instances when the pouch 18 is positioned in an alternating manner within the pouch delivery device 12, the preloaded pouch characteristics will include a plurality of sequential movements allowing the robotic transfer device 14 to properly pick up each alternating pouch 18 and perform the sequential movements to articulate the gripper member 82 in a proper position to load the pouch 18 into the grippers 94 at the load position.

The optical sensor 84 is optionally a bar code reader which utilizes a scanner to read the indicia 34 in the form of a bar code or two dimensional data matrix, or a RFID reader which reads the indicia 34 in the form of a RFID tag. The optical sensor 84 optionally includes a camera which captures an image of the pouch 18 in the pouch delivery device 12 from the pre-pickup position and compares the captured image with a preloaded image stored in the database 90 with the preloaded pouch characteristics in order to determine that the pouch 18 is in the correct position to perform the sequential movements. An example of this includes pouches 18 stacked in an alternating manner wherein upon reading the indicia 34 the pouch characteristics state that the pouches are stacked in an alternating manner and includes a preloaded image of each pouch which corresponds to the sequential movements such that the captured image is compared to the preloaded image to confirm that the sequential movements are correct for the position of the pouch 18.

With reference to FIG. 1, the fill-seal machine 16 will now be discussed. The fill-seal machine 16 includes a plurality of stations each having a designated function. The stations include, in order of operation, a loading station 96, a first feature station 98, a second feature station 100, an opening station 102, a filling station 104, a gas removal station 106, a sealing station 108, and an unloading station 110.

The fill-seal machine 16 includes a rotating turret 112 which rotates a plurality of grippers 94 through each of the stations from the loading station 96 to the unloading station 110 wherein the pouch 18 is opened, filled, and sealed prior to exiting. During operation the pouch 18 is loaded into the fill-seal machine 16 at the loading station 96. The pouch 18 is then rotated to the first feature station 98 where a feature is added to the pouch 18. Next, the pouch 18 is rotated to the second feature station 100 where an additional feature is added, or in the alternative the feature applied at the first feature station 98 is finished. The pouch 18 is then rotated to the opening station 102 where the pouch 18 is opened using a pouch opener 334. An example of such a pouch opener 334 is disclosed in commonly assigned U.S. Pat. No. 7,584,593 entitled 'Method and Apparatus for Opening a Flexible Pouch Using Opening Fingers' issued on Sep. 8, 2009, which is hereby incorporated by reference.

In the alternative, the first feature station 98 is a first opening station where openers in the form of suction cups attached to the front wall 20 and the back wall and pull apart to open the pouch 18. In addition, the second feature station 100, is a second opening station where a diving rod enters the open upper edge 24 of the pouch 18 and extends towards the lower edge 26 and expands to fully open the area adjacent the lower edge 26 of the pouch 18.

Once the pouch 18 has been opened, a reciprocating opening device 219, described in greater detail below, enters the pouch 18 at the opening station 102 and rotates with the pouch 18 to the filling station 104 holding the pouch 18 open during travel. At the filling station 104 a diving funnel 336 enters the opened pouch 18 between opened fingers 224 of the reciprocating opening device 219. After filling, the pouch 18 rotates to the gas removal station 106 where oxygen inside the pouch 18 is replaced with an inert gas such as nitrogen or carbon dioxide. The gas removal station 106 is optionally a vacuum station or a dust extraction station. The pouch 18 then rotates to the sealing station 106 where the open end (upper edge 24) of the pouch 18 is sealed using heat, ultrasonics, adhesive or any combination thereof. Finally, the pouch 18 is rotated to the unloading station 110 where the pouch 18 exits the fill-seal machine 16 by conveyer 111.

Figure 2:
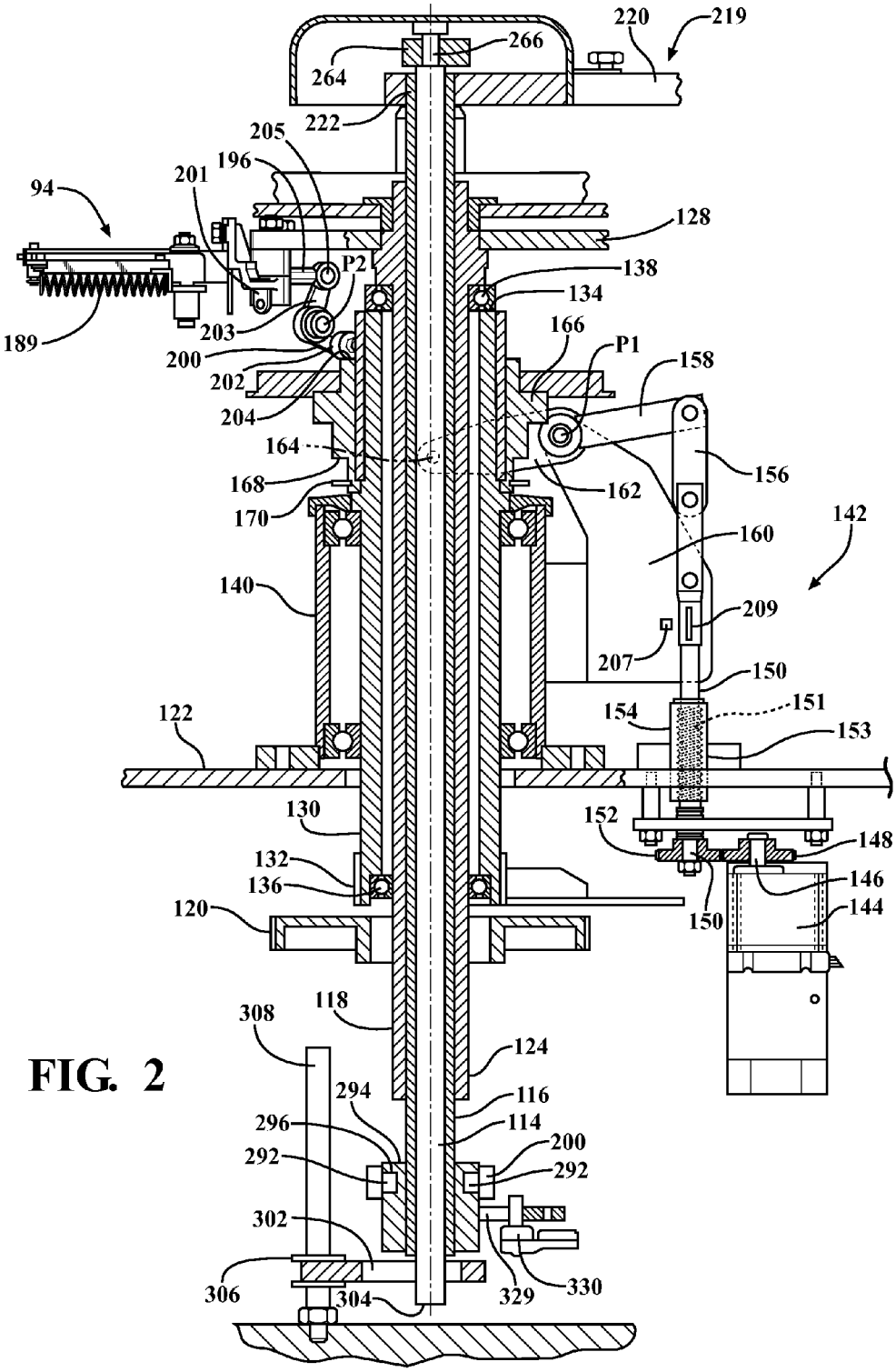
FIG. 2 is a cross-sectional view of the rotating turret.

With reference to FIG. 2, the rotating turret 112 will now be discussed in greater detail. The rotating turret 112 includes a central shaft 114 extending the longitudinal length of the rotating turret 112. A sleeve 116 is secured around the shaft 114 and is positioned within a first hollow shaft 118 for rotatable and vertical movement therethrough. The first hollow shaft 118 is connected to a gear 120 which is itself attached to a motor (not shown) disposed beneath a platform 122. The first hollow shaft 118 includes a lower end 124 disposed below the platform 122, and an upper end 126 connected to the gripper deck 128 upon which the grippers 94 are attached. The motor rotates the gear 120 to spin the first hollow shaft 118 in order to rotate the gripper deck 128 and consequently the grippers 94 thereby rotating a pouch 18 from the loading station 96 to the unloading station 110. The motor is an intermittent motor which rotates the grippers 94 through the plurality of stations of the fill-seal machine 16 resting at each station for a predetermined time in order to allow the functions of the various stations to be performed.

A second hollow shaft 130 is positioned around the first hollow shaft 118 and includes a first end 132 disposed above the gear 120 and a second end 134 disposed below the gripper deck 128. Ball bearings 136 are positioned adjacent the first end 132 of the second hollow shaft 130 and oil seals 138 are positioned adjacent the second end 134 of the second hollow shaft 130 to allow the second hollow shaft 130 to rotate about the first hollow shaft 118. The rotation of the second hollow shaft 130 is actuated by a main spindle housing 140. The rotation of the second hollow shaft 130 operates various timing mechanisms of the rotating turret 112 such as the opening and closing of the grippers 94.

A gripper width adjustment mechanism 142 is positioned on the platform 122. The gripper with adjustment mechanism 142 includes a motor 144 having a rotating shaft 146 secured to a gear 148. The motor 144 is operatively controlled by the control station 86 in order to automatically adjust the width of each of the grippers 94 in response operator input into the display/input device 92 or the preloaded pouch characteristics relating to the indicia 34 of the pouch 18.

A second rotating shaft 150 includes a second gear 152 in meshing contact with the gear 146 so as to spin the second shaft 150 upon rotation of the motor 144. The second shaft 150 extends through an aperture formed in the platform 122 and a bearing 154. The second shaft 150 includes a threaded portion 151 which corresponds to a threaded portion 153 of the bearing 154 such that rotation of the second shaft 150 vertically displaces the second shaft 150 either upwardly or downwardly depending upon the rotation of the motor.

A link member 156 is pivotally attached to a terminal end of the second shaft 150 and pivotally attached to a yoke 158 at an opposite end. The yoke 158 is pivotally attached to a flange 160, at pivot axis P1, connected to a non-rotating cover of the main spindle housing 140. The yoke 158 includes a generally U-shaped end portion 162 having pins 164 extending inwardly. The U-shaped end 162 of the yoke 158 is attached to a barrel cam 166 which is rotatably and slidingly attached about the second hollow shaft 130. The barrel cam 166 includes a stepped portion 168 and a radially extending tab 170 between which the pins 164 are disposed. The connection of the pins 164 between the stepped portion 168 and the tab 170 allows the yoke 158 to raise and lower the barrel cam 166 even during rotation of the barrel cam 166.

Figure 5:
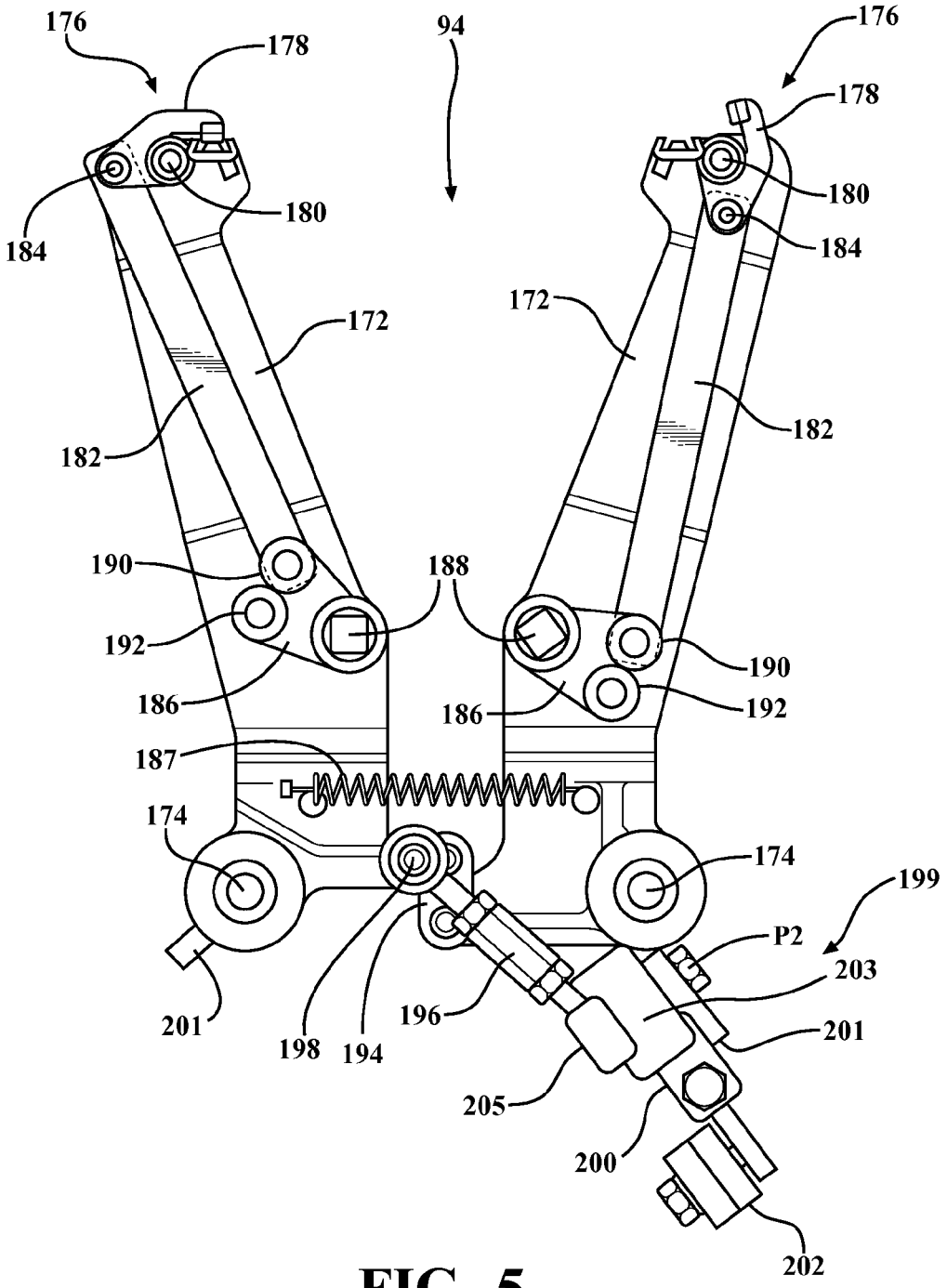
FIG. 5 is a top elevational view of the gripper pairs.

With reference to FIG. 5, the grippers 94 include a pair of gripper arms 172 which are pivotally attached to the gripper deck 128 at gripper base 174. Each gripper arm 172 includes a jaw mechanism 176 (shown in both the open and closed position in FIG. 5) located at the terminal ends of the gripper arms 172. Each of the jaw mechanisms 176 includes a jaw 178 which is pivotally attached to the terminal end of the gripper arms 172 by pins 180. A link member 182 pivotally attaches to the jaw 178 by pin 184 and pivotally attaches to a roller 190. The roller 190 is pivotally connected to pivot bracket 186. The pivot bracket 186 is pivotally attached to the gripper arms 172 by pins 188. The pivot brackets 186 include a second roller 192 in contact with the roller 190.

The pivot brackets 186 are operatively connected to the second hollow shaft 130 by a timing mechanism (not shown) and are operated by the timing mechanism to rotate when the grippers 94 are positioned at the loading station 96 and the unloading station 110 to grasp and release the pouches 18 articulating between the open position and the closed position. Upon rotation of the pivoting bracket 186 in a first direction, the roller 190 rolls in contact with the second roller 192 pulls the link member 182 which pivots the jaw 178 about pin 180 to open the jaw mechanism 176 when the particular gripper 194 is in the unloading station 96 and after a predetermined period of time set by the rotation of the second hollow shaft 130 and the timing mechanism, the pivoting bracket 186 rotates in an opposite second direction thereby pushing the link member 182 to pivot the jaw 178 about pin 180 closing the jaw mechanism 176 thereby securing the pouch 18 within the jaw mechanism 176.

As seen in FIGS. 2 and 4, jaw biasing members 189, such as a spring, biases the jaws 178 towards the closed position. Further, a gripper arm biasing member 187, such as a spring, extends between the gripper arms 172 to biases the gripper arms 172 together about the pivot points of the gripper base 174. A link 194 has each end pivotally connected to one of the gripper arms 172.

With reference to FIGS. 2 and 5, each of the plurality of grippers 94 includes an actuation mechanism 199 which operates to adjust the width of the adjacent gripper 94. The roller mechanism includes a rod 196 having a first end attached to one of the gripper arms 172 by a ball joint 198. An opposite end of the rod 196 is pivotally attached to a link 203 by ball joint 205. The link 203 connects a proximate end of a lever 200 about pivot axis P2. The lever 200 is also pivotally connected about pivot axis P2 to an extension 201 extending from a gripper arm 172 of an adjacent pair of grippers 94, as seen in FIGS. 2 and 4. A roller 202 is connected to the distal end of the lever 200 and rides on an edge 204 of the barrel cam 166.

For the interests of clarity, FIGS. 2 and 5 depict the gripper 94 and the actuation mechanism 199 connected to the extension 201 of the adjacent grippers 94. The attachment of the lever 200 to the extension 201 of the adjacent pair of grippers 94 offsets the rod 196 and link 203 to allow space for the articulation of the components as described in greater detail below.

Figure 6:
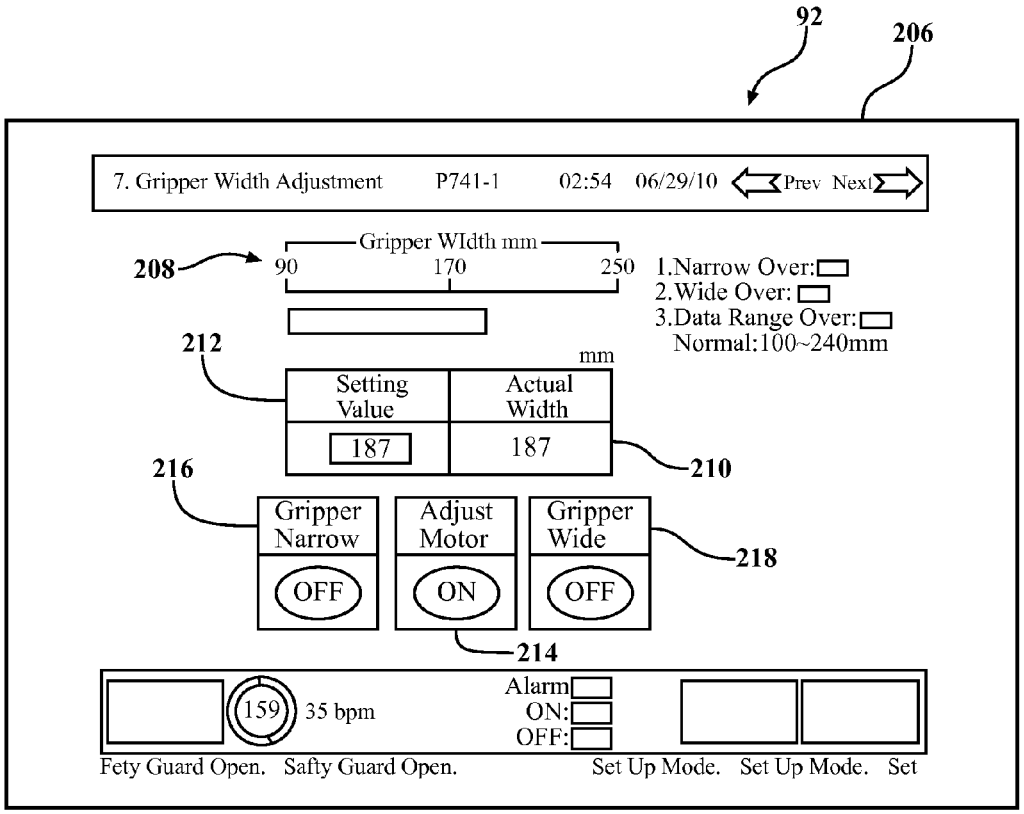
FIG. 6 is a schematic view illustrating the input display device of the control station.

In order to automatically adjust the width of the gripper 94 to accommodate various sized pouches 18, an operator enters a desired width into the display/input device 92 of the control station 86 as seen in FIG. 6. The display/input device 92 includes a display screen 206 having touch controls or another input device such as a keyboard/mouse. The display screen 206 provides an operator with gripper width information including the range of gripper width 208, the actual width of the grippers 210, and the operator set value of the grippers 224 width. The set value 212 allows an operator to input a selected gripper width having a range between 90 millimeters at a narrowest setting and 250 millimeters at a widest setting. Upon inputting a desired gripper width an operator adjusts gripper 94 width by actuating the adjust motor button 214. The display device 92 also provides the operator with a gripper narrow button 216 which narrows the width of the gripper 94 to its narrowest setting and a gripper wide button 218 which widens the gripper width to its widest setting.

In the alternative, the robotic transfer device 14 articulates the swivel plate 80 into the pre-pick up position above the pouch delivery device 12. The optical sensor 84 then scans the indicia 34 and the controller 88 in the control station 86 accesses the database 90 in order to match the scanned indicia 34 with the preloaded pouch characteristics including pouch width.

Upon inputting a selected gripper width by an operator into the display/input device 92 of the control station 86 or from the preloaded pouch characteristics stored on the database 90, the controller 88 sends a signal to motor 144 to rotate shaft 146 in a first direction to narrow the gripper 94 width or a second direction to widen the gripper 94 width. The rotating shaft 146 rotates the gear 148 which consequently rotates gear 152 and the second shaft 150. As the second shaft 150 includes a threaded portion disposed within the threaded bearing 154, rotation of the gear 152 will vertically raise or lower the second shaft 150. Upon vertical movement of the second shaft 150, the yoke 158 will pivot around pivot axis P1 to slide the barrel cam 166 upwardly or downwardly about the second hollow shaft 130.

As the roller 202 rides on the cam edge 204 the roller 202 is consequently vertically displaced with the barrel cam 166. The vertical displacement of the roller 202 causes the lever 200 to pivot about pivot axis P2 thereby rotating link 203 to drive the rod 196. Raising the barrel cam 166 operates to raise the roller 202 which pivots the lever 200 about pivot axis P2 in a first direction which rotates the link 203 to push the rod 196. Forward movement of the rod 196 pushes the gripper arm 172 attached to the rod 196 by the ball joint 198. The gripper arms 172 pivot about gripper bases 174 in response to the forward movement of the rod 196 to widen the width of the grippers 94. Lowering the barrel cam 166 operates to lower the roller 202 to pivot the lever 200 about pivot axis P2 in a second direction which rotates the link to pull the rod 196. Reward movement of the rod 196 pulls the gripper arm 172 attached to the rod 196 by the ball joint 198. The gripper arms 172 pivot about the gripper bases 174 in response to the reward movement of the rod 196 to narrow the width of the grippers 94. As each of the plurality of gripper arms 94 includes an actuation mechanism 199 attached to the adjacent grippers 94, the widths of the terminal ends of each of the gripper arms 172 are selectively adjusted, by operator input into the display/input device 92 or pouch characteristics relating to the scanned indicia 34, to receive a variety of pouch having sizes.

A proximity sensor 207 is positioned on the flange 160 and senses the presence of a tab 209 extending from the second shaft 150. The proximity sensor 207 is connected to the control station 86 to stop operation of the motor 144 if the sensor 207 does not sense the tab 209. The proximity sensor 207 prevents the motor 144 from rotating the second shaft 150 beyond an upper or lower threshold to avoid damage to the gripper adjustment mechanism 142.

Figure 7:
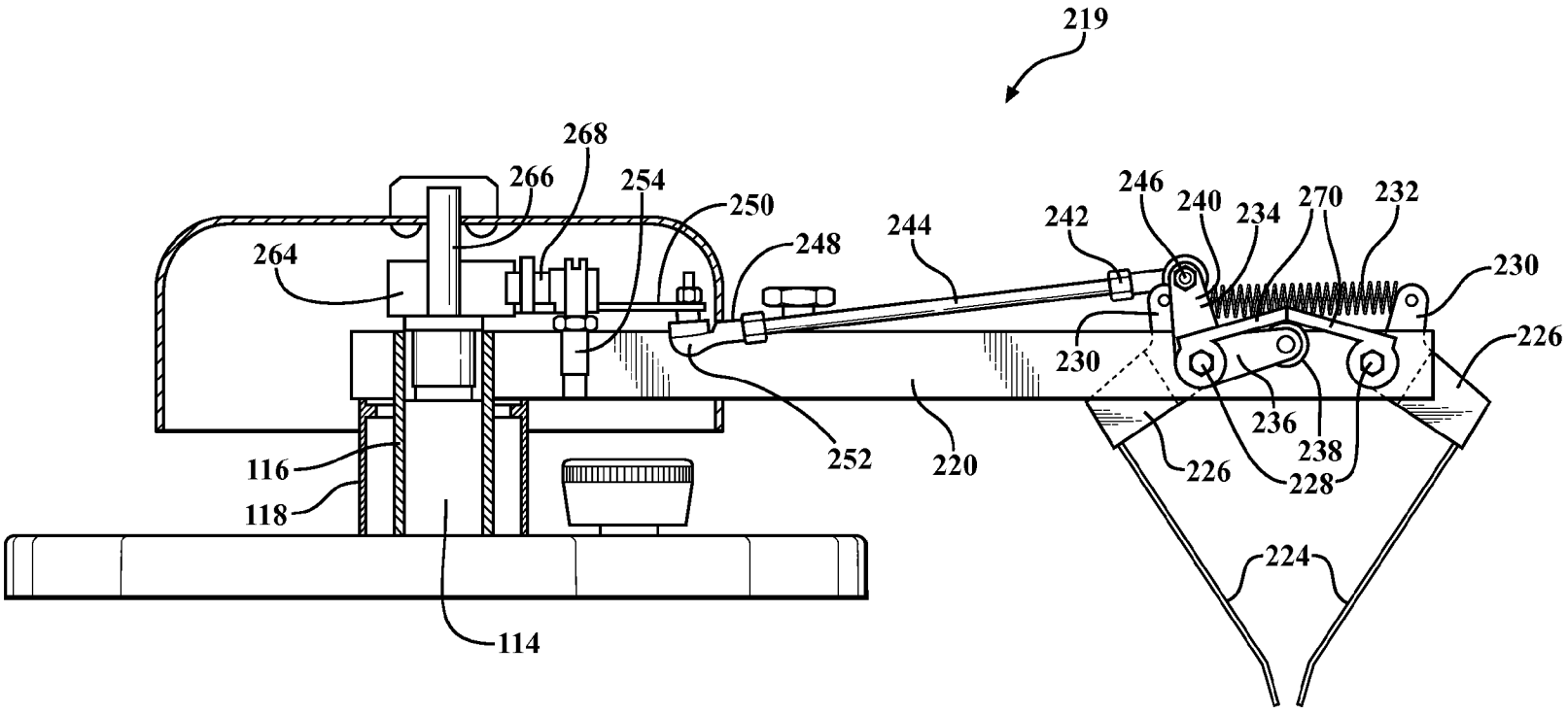
FIG. 7 is a partial side elevational view of the reciprocating opening mechanism.
Figure 8:
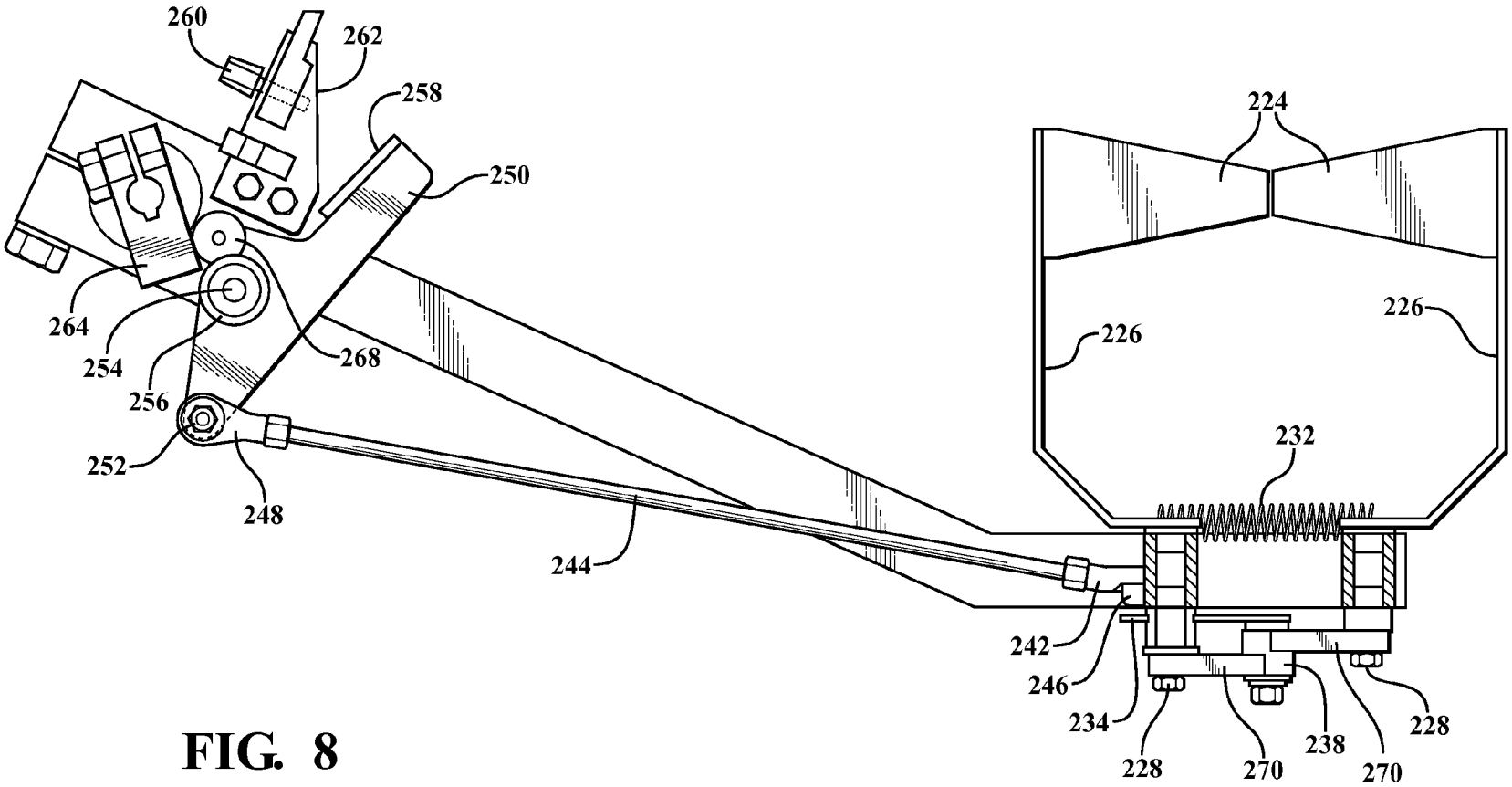
FIG. 8 is a partial top elevational view of the reciprocating opening mechanism.

With reference to FIGS. 1, 2, 7 and 8, a reciprocating opening device is generally indicated at 219. The reciprocating opening device 219 includes a traveling arm 220 attached to an upper end 222 of the sleeve 116 and the center shaft 114. A distal end of the traveling arm 220 has a pair of opening fingers 224 attached to brackets 226 which are pivotally attached to the distal end of the traveling arm 220 by pins 228 allowing the opening fingers 224 to move from a closed position (as seen in FIGS. 7 and 8) to an open position with the terminal ends spaced apart. The brackets 226 include extensions 230 between which a biasing member 232, such as a spring, is disposed to bias the opening fingers 224 towards the open position.

A rotating bracket 234 is pivotally attached to the inner bracket 226 by pin 228. The rotating bracket 234 includes a first arm 236 having a roller 238 and a second arm 240 having a distal end 242 of a rod 244 attached by a ball joint 246. As seen in FIG. 8, the proximate end 248 of the rod 244 is attached to a pivoting bracket 250 by ball joint 252. The bracket 250 is pivotally attached to the traveling arm 220 by pin 254. A roller 256 is affixed to the pin 254 such that rotation of the roller 256 rotates the bracket 250 about the pin 254. The bracket 250 includes a stopper plate 258 which contacts a stopper 260 of stopper bracket 262 attached to the traveling arm 220. The stopper 260 limits the pivoting movement of the bracket 250 and thereby the distance between the opening fingers 224 in the open position. The stopper 260 in the illustrated embodiment is a bolt threaded through an aperture of the stopper bracket 262. The length of stopper 260 extending beyond the stopper bracket 262 is adjustable to vary the distance between the opening fingers 224 in the open position.

A cam 264 attached to a fixed post 266 extending from the central shaft 114 rotates in conjunction with the shaft 114 and contacts a contacting member 268 attached to the bracket 250. Upon rotation of the shaft 114 and the fixed post 266, the cam 264 will contact the contact member 268 causing the bracket 250 to pivot about pin 254. The pivotal movement of the bracket 250 drives the rod 244 which rotates the rotating bracket 234 about the pin 228. A finger 270 is attached to each of the pins 228. The fingers 270 rest on the roller 238 in an offset manner as best seen in FIG. 8. Upon rotation of the rotating bracket 234, the biasing member 232 no longer biased by the position of the roller 238 with respect to the fingers 270, pivots the brackets 226 and consequently the opening fingers 224 from a closed position to an open position. Upon rotation of the central shaft 114 in an opposite direction, the cam 264 rotates to stop biasing the contacting member 268 which rotates the bracket 250. The pivotal movement of the bracket 250 operates to pull the rod 244 in a rearwardly direction thereby rotating the bracket 234 bringing the first arm 236 upwardly. The movement of the first arm 236 raises the roller 238 which rotates the fingers 270 which rotates the opening fingers 224 from the open position to the closed position against the biasing force of the biasing member 232.

Figure 9:
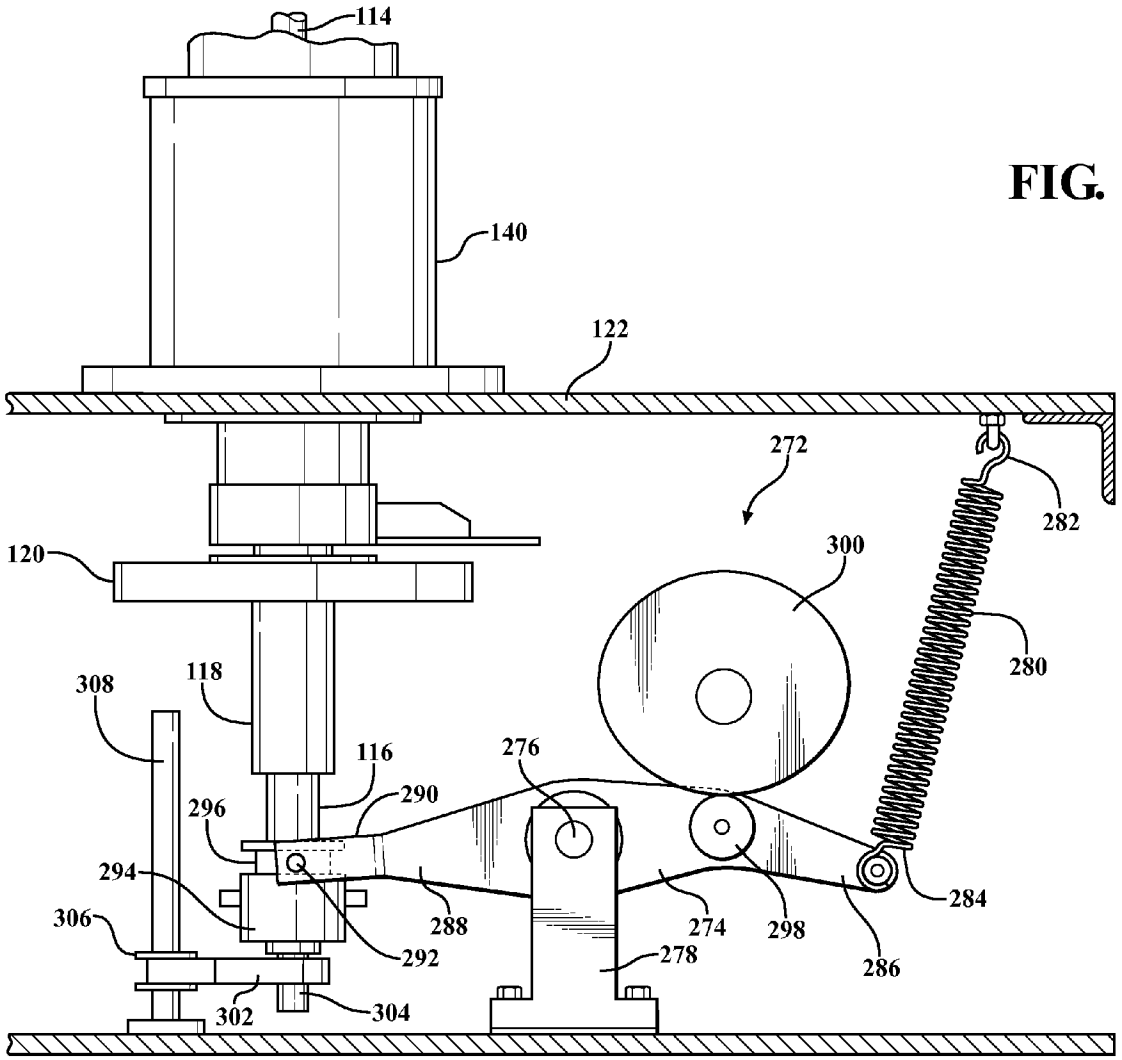
FIG. 9 is a side elevational view of the vertical adjustment mechanism.

The vertical movement of the reciprocating opening device 219 will now be discussed. With reference to FIG. 9, a vertical cam mechanism 272 vertically adjusts the shaft 114 and the sleeve 116 so as to raise and lower the traveling arm 220. The vertical cam mechanism 272 includes a lever 274 pivotally attached by pin 276 to a post 278. A biasing member 280 has a first end 282 attached to the lower side of the platform 122 and a second end 284 attached to a first end 286 of the lever 274. The second end 288 of the lever 274 includes a yoke 290 having a generally U shape with inwardly extending pins 292. The yoke 290 is attached to a connector 294 fixedly secured to the sleeve 116 and the shaft 114. The connector 294 includes a collar 296 in which the pins 292 of the yoke 290 are connected. The connection between the pins 292 of the yoke 290 and the collar 296 of the connector member 294 allows the vertical cam mechanism 272 to raise the connector 294 even during rotation of the connector 294.

Disposed between the pin 276 and the first end 286 of the lever 274 is a roller 298 in contact with a rotating cam 300. The rotating cam 300 has an oblong shape which upon rotation drives the roller 280 to pivot the lever 274 about pin 276. During rotation of the cam 300 as the distance between the center point of the cam and the roller 298 decreases, the first end 286 of the lever 274 is pulled upwardly due to the biasing force of the biasing member 280 and the second end 288 of the lever 274 is pivoted downwardly. As the pins 296 of the yoke 290 are seated within the collar 296 of the connector 294, the downwardly movement of the second end 288 vertically displaces the connector 294 and consequently the sleeve 116 and the shaft 114 downwardly. As the traveling arm 220 is attached to the upper end 222 of the shaft 114, the downward displacement of the shaft 114 downwardly displaces the reciprocating opening device 219 which descends the opening fingers 224 into the upper edge 24 of pouch 18 in the opening station 102.

As the cam 300 continues to rotate and the distance between the center point of the cam 300 and the roller 298 increases, the first end 286 of the lever 274 is pushed downwardly against the biasing force of the biasing member 280 and the second end 288 of the lever 274 is pivoted upwardly. As the pins 296 of the yoke 290 are seated within the collar 296 of the connector 294, the upwardly movement of the second end 288 vertically displaces the connector 294 and consequently the sleeve 116 and the shaft 114 upwardly. As the traveling arm 220 is attached to the upper end 222 of the shaft 114, the upward displacement of the shaft 114 upwardly displaces the reciprocating opening device 219 which raises the opening fingers 224 from the pouch 18 at the filing station 104.

A guide 302 is attached to the lower end 304 of the shaft 114. The guide 302 includes a bushing 306 in sliding contact about a guide post 308 upon which the bushing 306 rides during the vertical displacement of the shaft 114. The guide 302 provides stability to the rotating turret 112 during vertical displacement of the central shaft 114 by the vertical cam mechanism 272.

Figure 10:
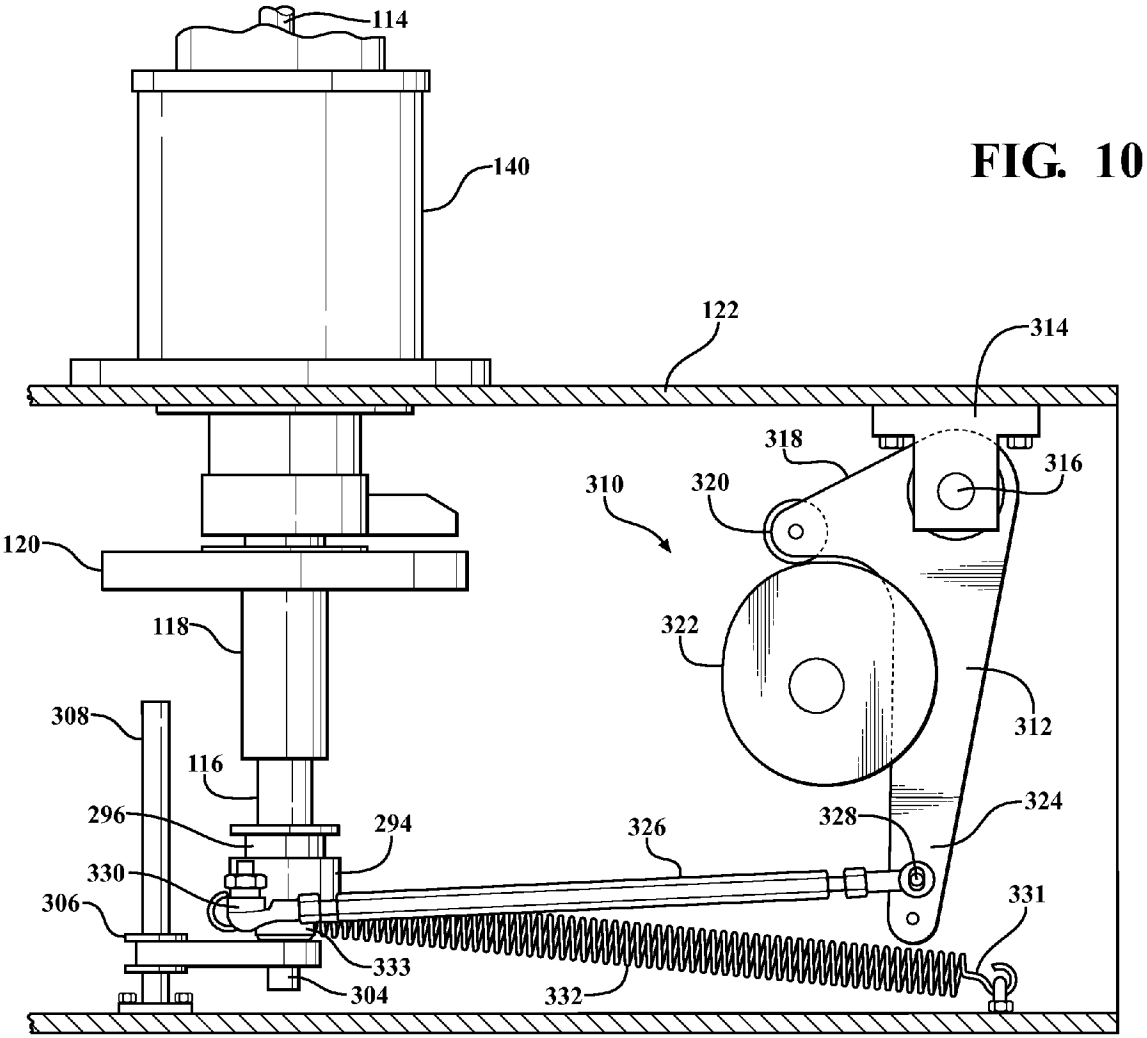
FIG. 10 is a side elevational view of the rotating adjustment mechanism.

The reciprocating rotational movement of the reciprocating opening device 219 between the opening station 102 and the filling station 104 will now be discussed. With reference to FIG. 10, a rotating cam mechanism 310 is provided to reciprocatingly rotate the reciprocating opening device 219 from the opening station 102 to the filling station 104. The rotating cam mechanism 310 includes a bracket 312 having a generally L shape pivotally attached to a post 314 by a pin 316 at a central portion. The post 314 is attached to a lower side of the platform 122. The bracket 312 includes a first arm 318 having a roller 320 attached at a terminal end. The roller 320 is in rolling contact with a rotating cam 322 having an oblong shape. A second arm 324 is attached to a rod 326 by a ball joint 328. An opposite end of the rod 326 is attached to a tab 329 extending from the connector 294 by a ball joint 330. A biasing member 332 has a first end 331 affixed to the floor and a second end 333 affixed to the connector member 294.

During rotation of the rotating cam 322 as the distance between the central point of the cam 322 and the roller 320 decreases, the bracket 312 pivots about the pin 316 to rotate the second arm 324 in forward direction. The movement of the second arm 324 drives the rod 326 forward which rotates the connector 294. The rotation of the connector 294 rotates the sleeve 116 and the central shaft 114 from an opening position, in which the reciprocating opening device 219 is positioned at the opening station 102, and a filling position, in which the reciprocating opening device 219 is positioned at the filling station 104. Further, the rotation of the central shaft 114 by the rotating cam mechanism 310 from the opening position to the filling position rotates the reciprocating opening device 219 from the opening station 102, as seen in FIG. 1, to the filling station 104, as seen in ghost in FIG. 1. Further, the rotation of the central shaft 114 operates the opening fingers 224 from the closed position to the open position as the reciprocating opening device 219 rotates from the opening station 102 to the filling station 104.

During rotation of the cam 322 as the distance between the central point of the cam 322 and the roller 320 increases the bracket 312 pivots about the pin 316 to rotate the second arm 324 in rearward direction. The movement of the second arm 324 drives the rod 326 rearward which rotates the connector 294. The rotation of the connector 294 rotates the sleeve 116 and the central shaft 114 from the filling position, in which the reciprocating opening device 219 is positioned at the filling station 104, and the opening position, in which the reciprocating opening device 219 is positioned at the opening station 102. Further, the rotation of the central shaft 114 by the rotating cam mechanism 310 from the filling position to the opening position rotates the reciprocating opening device 219 from the filling station 104, as seen in ghost in FIG. 1, to the opening station 102, as seen in FIG. 1. Further, the rotation of the central shaft 114 operates the opening fingers 224 from the open position to the closed position as the reciprocating opening device 219 rotates from the filling station 104 to the opening station 102.

With reference to FIG. 1, the reciprocating opening device 219 is depicted in the opening position at the opening station 102. The traveling arm 220 is raised and the opening fingers 224 are in a closed position. The vertically adjusting cam mechanism 272 and the rotating cam mechanism 310 are timed to operate in conjunction to lower the traveling arm 220 with the opening fingers 224 in the closed position into the pouch 18 and articulating the opening fingers 224 into the open position as the reciprocating opening device 219 rotates with the pouch 18 from the opening station 102 to the filling station 104.

Supplemental openers 334, such as suction cups, are optionally disposed at the opening station 102 on either side of the pouch 18 have at least partially opened the upper edge 24 of the pouch 18. In the alternative, the upper edge 24 of the pouch 18 has been previously opened by the first feature station 98 in the form of a first opening station and the remainder of the pouch 18, the area adjacent the lower edge 26, has been opened by the second feature station 100 in the form of a second opening station.

The cam 300 of vertically adjusting cam mechanism 272 rotates allowing the first end 286 to be raised by the biasing member 280. The upward movement of the first end 286 consequently lowers the second end 288 which due to the attachment of the yoke 290 to the connecting member 294 lowers the connecting member 294, the shaft 114, and the reciprocating opening device 219. The lowering of the reciprocating opening device 219 operates to lower the traveling arm 220 and opening fingers 224 into the open end of the pouch 18.

As the opening fingers 224 descend within the pouch 18, the cam 322 of the rotating cam mechanism 310 rotates the connector 294, the shaft 114 and the reciprocating opening device 219. The rotation of the shaft 114 rotates the cam 264 so as to abut the contacting member 268 pivoting the bracket 250 about pin 254 which pushes rod 244 forward, rotating rotating bracket 234 such that the roller 238 is lowered thereby pivoting the fingers 270 allowing the biasing mechanism 232 to bias the opening fingers from the closed position to the open position thereby opening the upper edge 24 of the pouch 18. Further, as the reciprocating opening device 219 rotates with the rotation of the shaft 114 by the rotating cam mechanism 310, the traveling arm 220 which has descended with the opening fingers 224 opens the upper edge 24 of the pouch 18 as the pouch 18 rotates with the grippers 94 from the opening station 102 to the filling station 104.

With the reciprocating opening device 219 is now in the filling position at the filling station 104 as seen in ghost in FIG. 1. The traveling arm 220 is in a descended position and the opening fingers 224 are in the open position, a diving filling funnel 336 is descended by an actuator 338 into the open pouch 18 between the opening fingers 224, as shown in FIG. 12. Product now descends from a chute (not shown) through the funnel 336 to fill the pouch 18 in the filling station 104. Upon completion of filling the pouch 18 with product, the funnel 336 is raised by actuator 338 from a descended position to a raised position in the direction of arrow A, shown in FIG. 11. At the same time, the rotating cam mechanism 310 and the vertical adjusting cam mechanism 272 operate in conjunction to articulate the reciprocating opening device 219 from the filling position at the filling station 104 back to the opening position at the opening station 102. The cam 300 of the vertical cam mechanism 272 rotates lowering the first end 286 and raising the second end 288 which raises the connector member 294, the shaft 114 and the reciprocating opening device 219. The upward movement of the reciprocating opening device 219 raises the opening fingers 224 out of the pouch 18. During the rotation from the filling station 104 to the opening station 102, the cam 322 of the rotating cam mechanism 310 rotates pivoting the lever 312 allowing the biasing member 332 to rotate the connector member 294, the shaft 114 and the reciprocating opening device 219 from the filling position at the filling station 104 to the opening position at the opening station 102. During rotation of the reciprocating opening device 219 the cam 264 attached to the shaft 114 rotates allowing the bracket 250 to pivot about pivot pin 254 which pulls rod 244 rotating bracket 234 raises roller 238 which lifts fingers 270 pivoting the opening fingers 224 into the closed position against the biasing force of the biasing member 232.

It is appreciated, of course, that the traveling arm 220 is operated in a reciprocating manner traveling with the pouch 18 from the opening station 102 to the filling station 104 keeping the pouch 18 open to facilitate the descent of the funnel 336 into the pouch 18 and travel back to the opening station 102 in order to open the next pouch 18 which has rotated into the opening station 102.

The reciprocating opening device 219 is optionally controllable by the control station 86 through operator input into the display/input device 92. This allows an operator to stop the reciprocating movement of the reciprocating opening device 219 and the vertical cam mechanism 271 and the rotating cam mechanism 310.

Figure 11:
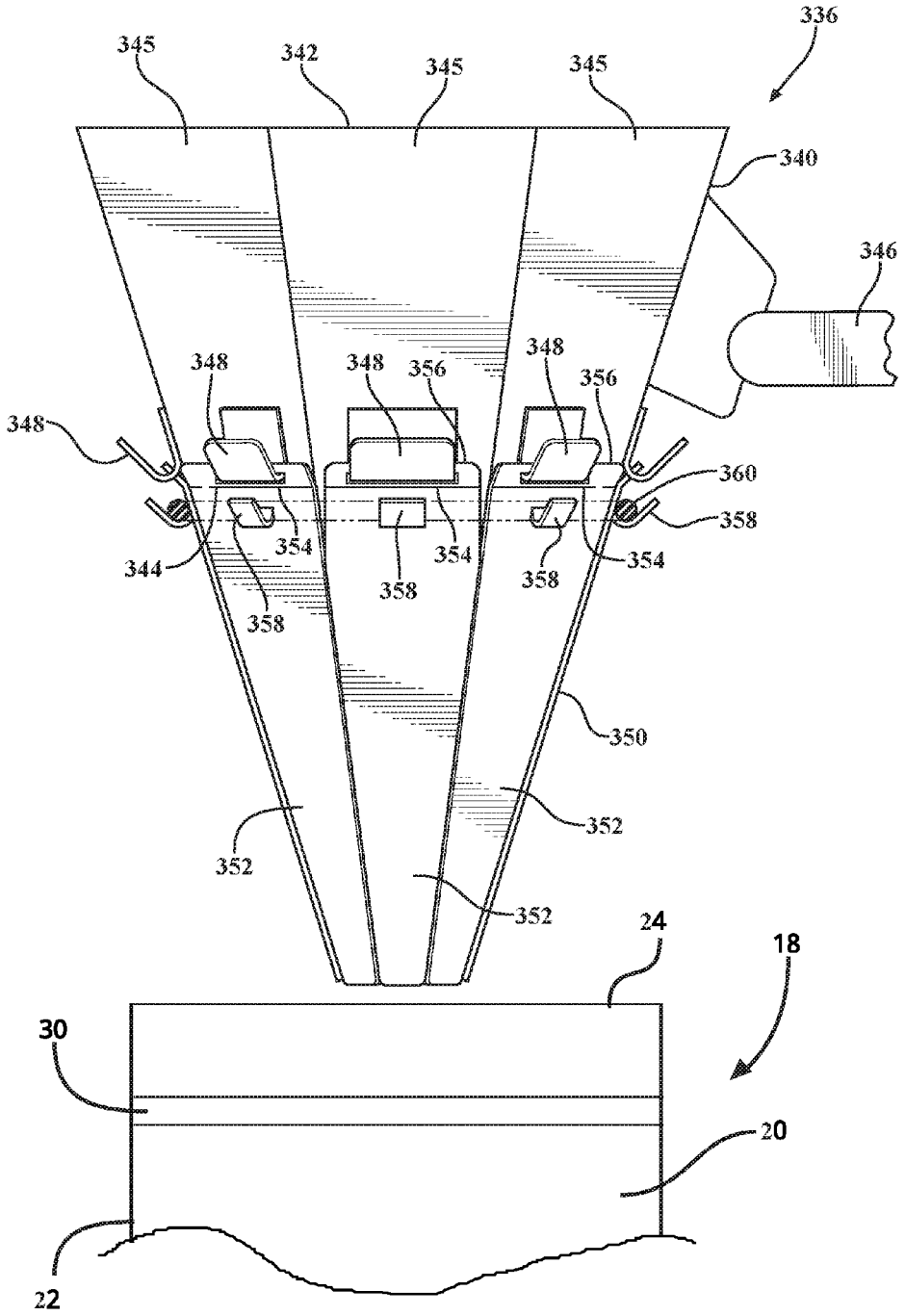
FIG. 11 is a side elevational view of the diving funnel raised above a pouch.
Figure 12:
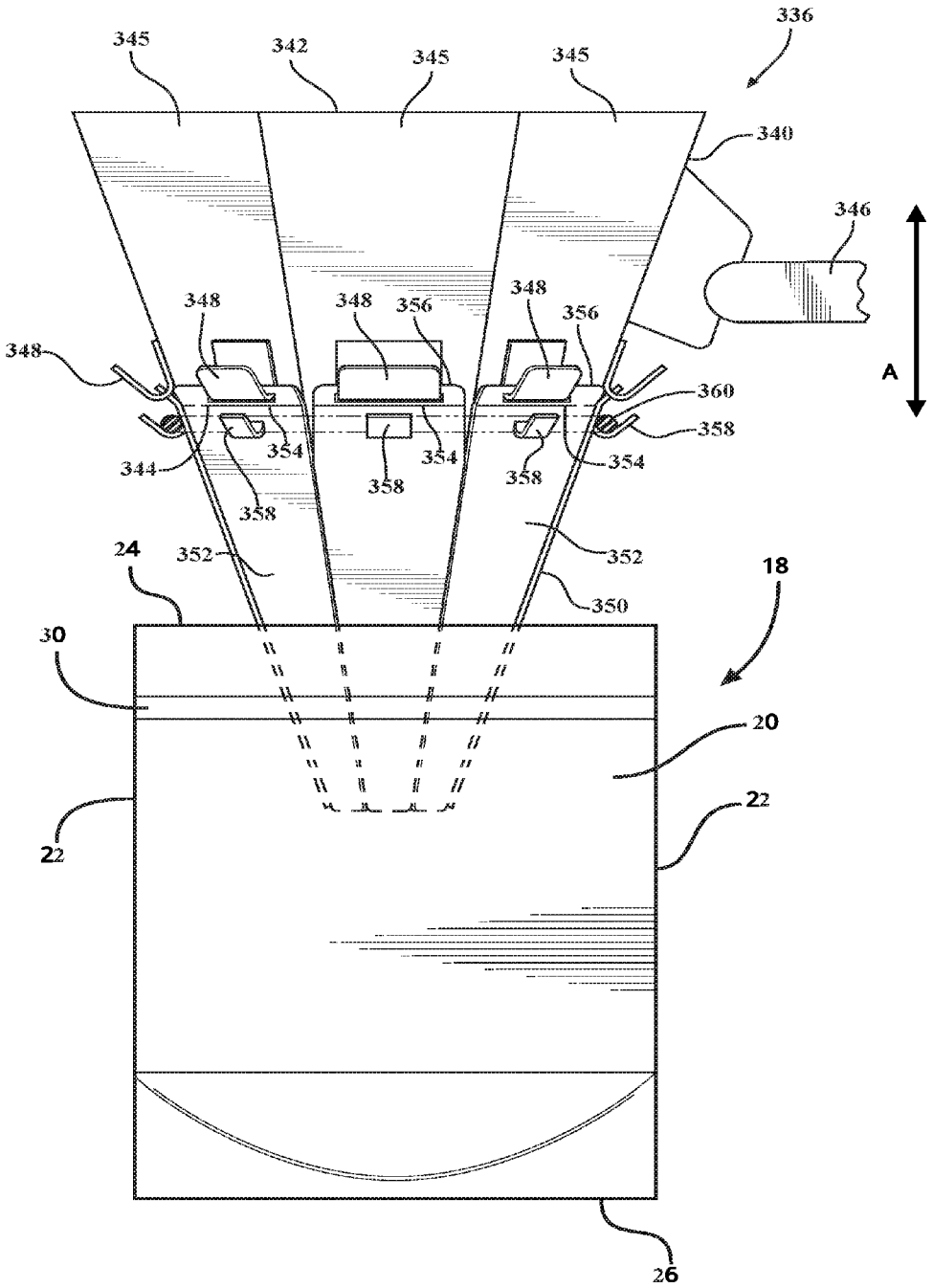
FIG. 12 is a side elevational view of the diving funnel in which a portion of the diving funnel enters an interior of the flexible pouch.

With reference to FIG. 11, the diving funnel 336 will now be discussed. The diving funnel 336 has a rigid upper portion 340 having an open top end 342 and an open bottom end 344. The rigid upper portion is attached to the actuator 338 by arm 346. The rigid upper portion has a regular polygon shape such as an octagon which tapers from the open top end 342 to the open bottom end 344. The regular polygon shape of the upper rigid portion 340 defines a plurality of sides 345 each having a hook 348 positioned adjacent the open bottom end 344. The diving funnel 336 includes a flexible lower portion 350 formed of a plurality of individually articulatable fingers 352. The plurality of fingers 352 each include a slot 354 formed adjacent the upper edge 356 of the fingers 353. The slot 354 on each of the plurality of fingers 352 received the hook 348 on each side 345 of the upper rigid portion 340 such that each of the plurality of individually articulatable fingers 352 are hingedly connected to an exterior surface of the upper rigid portion 340. A tab 358 extends from the outer surface of each finger 352 for receiving an elastic member 360, such as a rubber band, to secure the fingers 352 into a generally frustoconical shape.

During filling of the pouches 18, the lower flexible portion 350 enters the upper portion 24 of the pouch 18 between the opening fingers 224. Product then enters the open top portion 342 and extends through the rigid portion 340 exiting the open bottom portion 344 thereby entering the flexible lower portion 350. The fingers 352 in conjunction with the elastic member 360 provide a cushioning as the product descends through the funnel 336 in order to direct the product within the pouch 18 without damaging the product or clogging the flexible funnel 336. The lower flexible portion 350 allows the product to hinge any of the plurality of fingers 352.

Having described the invention, however, many modifications thereto will become apparent to those skilled in the art to which it pertains without deviation from the spirit of the invention as defined by the scope of the appended claims.

It is claimed:

1. A flexible funnel positioned at a filling station of a fill machine, said flexible funnel directing a product, dispensed at said filling station, into a pouch, said flexible funnel comprising:

a rigid upper portion having an open top end and an open bottom end, the rigid upper portion having a regular polygon shape having a plurality of sides;

a plurality of elongated fingers, each of said plurality of fingers being hingedly connected to an exterior surface of one of said plurality of sides of said rigid upper portion, each of said plurality of fingers is individually articulable in a radial direction; and an annular elastic member that extends around an outer surface of each of said plurality of fingers to partially restrain movement of said plurality of fingers, wherein each of said plurality of sides of said rigid upper portion tapers from said open top end to said open bottom end such that said open top end is larger than said open bottom end.

2. The flexible funnel of claim 1, wherein each of said plurality of fingers includes an upper end and an opposite a lower end, and wherein each of said upper ends of said plurality of fingers is hingedly connected to a portion of said open bottom end.

3. The flexible funnel of claim 2, wherein each of said plurality of sides having one of a hook or a slot positioned at said open bottom end, and each of said plurality of fingers having the other of said hook or slot positioned at said upper end of each of said plurality of fingers, and wherein each of said slots receives one of said hooks to hingedly connect one of said plurality of fingers to each of said plurality of sides.

4. The flexible funnel of claim 3, wherein each of said plurality of fingers tapers from said upper end to said lower end.

5. The flexible funnel of claim 3, wherein said elastic member retains said plurality of fingers into a generally frustoconical shape.

6. The flexible funnel of claim 5, wherein each of said plurality of fingers includes a tab extending from said outer surface, each of said tabs receives a portion of said elastic member to prevent movement of said elastic member in a longitudinal direction of said flexible funnel.

7. A fill machine for filling a pouch with a product, said fill machine comprising:

a loading station into which the pouch is loaded into said fill machine;

a filling station; and a flexible funnel positioned at said filling station, said flexible funnel having a rigid upper portion, a plurality of fingers, and an annular elastic member, said rigid upper portion having an open top end and an open bottom end, the rigid upper portion having a regular polygon shape having a plurality of sides, each of said plurality of elongated fingers is hingedly connected to an exterior surface of one of said plurality of sides of said rigid upper portion, said annular elastic member extends around an outer surface of each of said plurality of fingers to partially restrain movement of said plurality of fingers;

wherein said flexible funnel directs the product dispensed at said filling station into the pouch, wherein each of said plurality of sides of said rigid upper portion tapers from said open top end to said open bottom end such that said open top end is larger than said open bottom end.

8. The fill machine of claim 7, wherein each of said plurality of fingers includes an upper end and an opposite a lower end, and wherein each of said upper ends of said plurality of fingers is hingedly connected to a portion of said open bottom end.

9. The fill machine of claim 8, wherein each of said plurality of sides having one of a hook or a slot positioned at said open bottom end, and each of said plurality of fingers having the other of said hook or slot positioned at said upper end of each of said plurality of fingers, and wherein each of said slots receives one of said hooks to hingedly connect one of said fingers to each of said plurality of sides.

10. The fill machine of claim 9, wherein each of said plurality of fingers tapers from said upper end to said lower end.

11. The fill machine of claim 7, wherein said elastic member retains said plurality of fingers into a generally frustoconical shape.

12. The fill machine of claim 11, wherein each of said plurality of fingers includes a tab extending from said outer surface, each of said tabs receives a portion of said elastic member to prevent movement of said elastic member in a longitudinal direction of said flexible funnel.

13. The fill machine of claim 12, wherein said flexible funnel is reciprocatingly moveable in a vertical direction such that during a filling operation at said filling station said flexible funnel is lowered such that a portion of said flexible lower portion enters an interior of the pouch, and wherein upon completion of said filling operation said flexible funnel is raised to withdrawal said flexible lower portion from the pouch interior.

14. A flexible funnel positioned at a filling station of a fill machine, said flexible funnel directing a product, dispensed at said filling station, into a pouch, said flexible funnel comprising:

a rigid upper portion having an open top end and an open bottom end, the rigid upper portion having a regular polygon shape having a plurality of sides, each of said plurality of sides having a hook on an exterior surface of said plurality of sides of said rigid upper portion, said hook of each of said plurality of sides positioned above said open bottom end of said rigid upper portion;

a plurality of elongated fingers, each of said plurality of fingers having a slot that engages with said hook on said plurality of sides of said rigid upper portion such that each of said plurality of fingers is hingedly connected to one of said plurality of sides of said rigid upper portion, each of said plurality of fingers is individually articulable; and an annular elastic member that extends around an outer surface of each of said plurality of fingers to partially restrain movement of said plurality of fingers.

* * * * *